US011072168B2

(12) United States Patent
Sugai

(10) Patent No.: US 11,072,168 B2
(45) Date of Patent: Jul. 27, 2021

(54) DROPLET DISCHARGE HEAD

(71) Applicant: SEIKO EPSON CORPORATION, Tokyo (JP)

(72) Inventor: Keigo Sugai, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/719,479

(22) Filed: Dec. 18, 2019

(65) Prior Publication Data

US 2020/0198337 A1 Jun. 25, 2020

(30) Foreign Application Priority Data

Dec. 21, 2018 (JP) ..... JP2018-239218

(51) Int. Cl.
*B41J 2/045* (2006.01)
*B41J 2/14* (2006.01)

(52) U.S. Cl.
CPC ..... *B41J 2/04581* (2013.01); *B41J 2/04588* (2013.01); *B41J 2/14201* (2013.01); *B41J 2202/15* (2013.01)

(58) Field of Classification Search
CPC ..... B41J 2/025; B41J 2/03; B41J 2/045; B41J 2/04581; B41J 2/04588; B41J 2/14201; B41J 2/14233; B41J 2/14274; B41J 2/1437; B41J 2202/05; B41J 2202/15
See application file for complete search history.

(56) References Cited

U.S. PATENT DOCUMENTS

| | | | | |
|---|---|---|---|---|
| 5,933,168 | A | 8/1999 | Sakai | |
| 2008/0018715 | A1* | 1/2008 | Wee | B41J 2/14233 347/70 |
| 2011/0169897 | A1* | 7/2011 | Yokoyama | B41J 2/14233 347/70 |
| 2011/0228012 | A1* | 9/2011 | Yoshida | B41J 2/14274 347/68 |
| 2018/0126738 | A1* | 5/2018 | Fukuda | B41J 2/0451 |
| 2020/0198329 | A1* | 6/2020 | Sugai | B41J 2/04541 |

FOREIGN PATENT DOCUMENTS

| | | | |
|---|---|---|---|
| JP | H09-327909 | A | 12/1997 |
| JP | 2000-141647 | A | 5/2000 |
| JP | 2008-126583 | A | 6/2008 |
| JP | 2013-180226 | A | 9/2013 |

* cited by examiner

*Primary Examiner* — Anh T Vo
(74) *Attorney, Agent, or Firm* — Chip Law Group

(57) ABSTRACT

A droplet discharge head each includes a first liquid chamber formed on a flow path forming substrate, a nozzle communicating with the first liquid chamber, and a first inflow path for supplying a liquid to the first liquid chamber, and a first actuator that individually changes a pressure in the first liquid chamber, a second actuator that changes pressures in a plurality of first liquid chambers in common, in which an amount of expansion/contraction of the second actuator is larger than that of the first actuator.

18 Claims, 25 Drawing Sheets

DROPLET DISCHARGE HEAD

The present application is based on, and claims priority from JP Application Serial Number 2018-239218, filed Dec. 21, 2018, the disclosure of which is hereby incorporated by reference herein in its entirety.

BACKGROUND

1. Technical Field

The present disclosure relates to a droplet discharge head.

2. Related Art

An example of a droplet discharge head that discharges minute droplets is JP-A-9-327909 and the like. JP-A-9-327909 discloses a droplet discharge head that abruptly draws a meniscus m that draws a meniscus m stationary at a nozzle opening, displaces a central region mc of the meniscus relatively large toward a pressure generation chamber, contracts a pressure generation chamber to generate an inertia flow when the movement of the central region of the meniscus to the pressure generation chamber is reversed, concentrates the inertial flow on the central region of the meniscus near the pressure generation chamber side, and extrudes only the central region at a high speed to stably discharge ink droplets thinner than the diameter of the nozzle opening at a speed suitable for printing.

However, when the droplet discharge head described in the above document is applied to a high-viscosity liquid of 50 mPa or more, the following problems occur. When a high-viscosity liquid of 50 mPa or more is discharged, the energy required for separating the droplets from the meniscus is larger than that of a discharged liquid of the related art. Therefore, in the droplet discharge head described in JP-A-9-327909, it is necessary to increase "the amount of expansion and contraction of an actuator" or "the area where a vibration plate forms a pressure generation chamber" in order to increase the excluded volume generated by the expansion and contraction of the actuator. In order to increase "the expansion/contraction amount of the actuator", the actuator becomes longer in the expansion/contraction direction. Accordingly, in order to maintain the rigidity of the actuator, the area of the surface of the actuator that comes into contact with the vibration plate increases, and it is difficult to dispose the nozzles at high density. In addition, when the "area in which the vibration plate forms the pressure generation chamber" is increased, the volume of the pressure generation chamber increases, and it is difficult to dispose the nozzles at high density.

SUMMARY

According to an aspect of the present disclosure, there is provided a droplet discharge head each including a first liquid chamber formed on a flow path forming substrate, a nozzle communicating with the first liquid chamber, and a first inflow path for supplying a liquid to the first liquid chamber, and a first actuator that individually changes a pressure in the first liquid chamber, a second actuator that changes pressures in a plurality of the first liquid chambers in common, in which an expansion/contraction amount of the second actuator is larger than that of the first actuator.

The droplet discharge head includes a first vibration plate forming a part of the wall surface of the first liquid chamber, in which the first actuator may be fixed to the first vibration plate, and the second actuator may displace the first vibration plate by displacing the first actuator.

In the droplet discharge head, the first actuator may be interposed between the second actuator and the first vibration plate.

The droplet discharge head includes a first vibration plate forming a part of the wall surface of the first liquid chamber, and a second vibration plate forming a part of the wall surface of the first inflow path, in which the first actuator may be fixed to the first vibration plate, and the second actuator may be fixed to the second vibration plate.

In the droplet discharge head, a plurality of the first actuators may be disposed with the second actuator interposed therebetween, the first actuator may be fixed to a bridging member, and the second actuator may be fixed to the bridging member In the droplet discharge head, a plurality of the second actuators may be provided, the plurality of second actuators may be disposed with the first actuator interposed therebetween, the plurality of second actuators may be fixed to a bridging member, and the bridging member may be fixed to a plurality of the first actuators.

The droplet discharge head includes a first vibration plate forming a part of a wall surface of the first liquid chamber, and a second vibration plate forming a part of the wall surface of the first liquid chamber, in which the first actuator may be fixed to the first vibration plate, and the second actuator may be fixed to the second vibration plate.

The droplet discharge head includes a nozzle plate forming part of a wall surface of the first liquid chamber, and a second vibration plate forming a part of the wall surface of the first liquid chamber, in which the nozzle may be formed on a nozzle plate, the first actuator may be fixed to the nozzle plate, and the second actuator may be fixed to the second vibration plate.

In the droplet discharge head, the first inflow path may include a second liquid chamber having a larger width than the first inflow path, and the second actuator may be fixed to the second vibration plate forming a part of a wall surface of the second liquid chamber.

The droplet discharge head includes a first vibration plate forming a part of a wall surface of the first liquid chamber, a second vibration plate forming a part of a wall surface of the first inflow path, and a displacement amplifying mechanism for amplifying an expansion/contraction amount of the second actuator to displace the second vibration plate, in which the first actuator may be fixed to the first vibration plate, and the second actuator may be fixed to the second vibration plate via the displacement amplifying mechanism.

The droplet discharge head includes an outflow path through which the liquid flows out from the first liquid chamber, a first vibration plate forming a part of a wall surface of the first liquid chamber, a second vibration plate forming a part of a wall surface of the outflow path, in which the first actuator may be fixed to the first vibration plate, and the second actuator may be fixed to the second vibration plate.

The droplet discharge head each includes a first liquid chamber formed on a flow path forming substrate, a nozzle communicating with the first liquid chamber, a first inflow path for supplying a liquid to the first liquid chamber, and a second inflow path communicating with the nozzle, and a first actuator that individually changes a pressure in the first liquid chamber, and a second actuator that changes pressures in the plurality of nozzles in common, in which an expansion/contraction amount of the second actuator may be larger than that of the first actuator.

The droplet discharge head described above is a droplet discharge head is mounted on a droplet discharge apparatus including a control unit for controlling droplet discharge, in which based on a drive signal from the control unit, the second actuator may be driven to draw a meniscus in the nozzle by depressurizing the first liquid chamber, and after the meniscuses in a plurality of the nozzles are drawn, the first actuator may be driven to discharge droplets from the nozzle by pressurizing the first liquid chamber.

In the droplet discharge head, the plurality of nozzles may include a first nozzle that discharges droplets and a second nozzle that does not discharge droplets, and based on a drive signal from the control unit, after the meniscuses in the plurality of nozzles are drawn, the first actuator corresponding to the first nozzle may be driven to pressurize the first liquid chamber communicating with the first nozzle, and after the meniscuses in the plurality of nozzles are drawn, the first actuator corresponding to the second nozzle may not be driven.

In the droplet discharge head, the plurality of nozzles may include a first nozzle that discharges droplets and a second nozzle that does not discharge droplets, and based on a drive signal from the control unit, when the second actuator is driven and the first liquid chamber is depressurized to draw the meniscus in the first nozzle and the second nozzle, the first actuator of the second nozzle may be driven to pressurize the first liquid chamber communicating with the first nozzle, and when the second actuator is driven and the first liquid chamber is pressurized to push the meniscus in the first nozzle and the second nozzle, the first actuator of the second nozzle may be driven to depressurize the first liquid chamber communicating with the first nozzle.

In the droplet discharge head, the plurality of nozzles may include a first nozzle that discharges droplets and a second nozzle that does not discharge droplets, in which a diameter of a droplet discharged from the first nozzle may be less than two-thirds of an opening of the first nozzle.

In the droplet discharge head, the speed at which the liquid column formed in the nozzle moves in the direction toward the nozzle opening may be higher than the speed at which the meniscus in the nozzle moves in the direction toward the nozzle opening.

According to another aspect of the present disclosure, there is provided a droplet discharge head each including a first liquid chamber formed on a flow path forming substrate, a nozzle communicating with the first liquid chamber, and a first inflow path for supplying a liquid to the first liquid chamber, and a first actuator that individually changes a pressure in the first liquid chamber, a second actuator that changes pressures in a plurality of the first liquid chambers in common, in which an excluded volume generated by the second actuator may be larger than an excluded volume generated by the first actuator.

DESCRIPTION OF EXEMPLARY EMBODIMENTS

Hereinafter, embodiments of the present disclosure will be described with reference to drawings. In the following drawings, the scale of each layer and each member is made different from an actual scale so that each layer and each member can be recognized.

Embodiment 1

Figure 1:
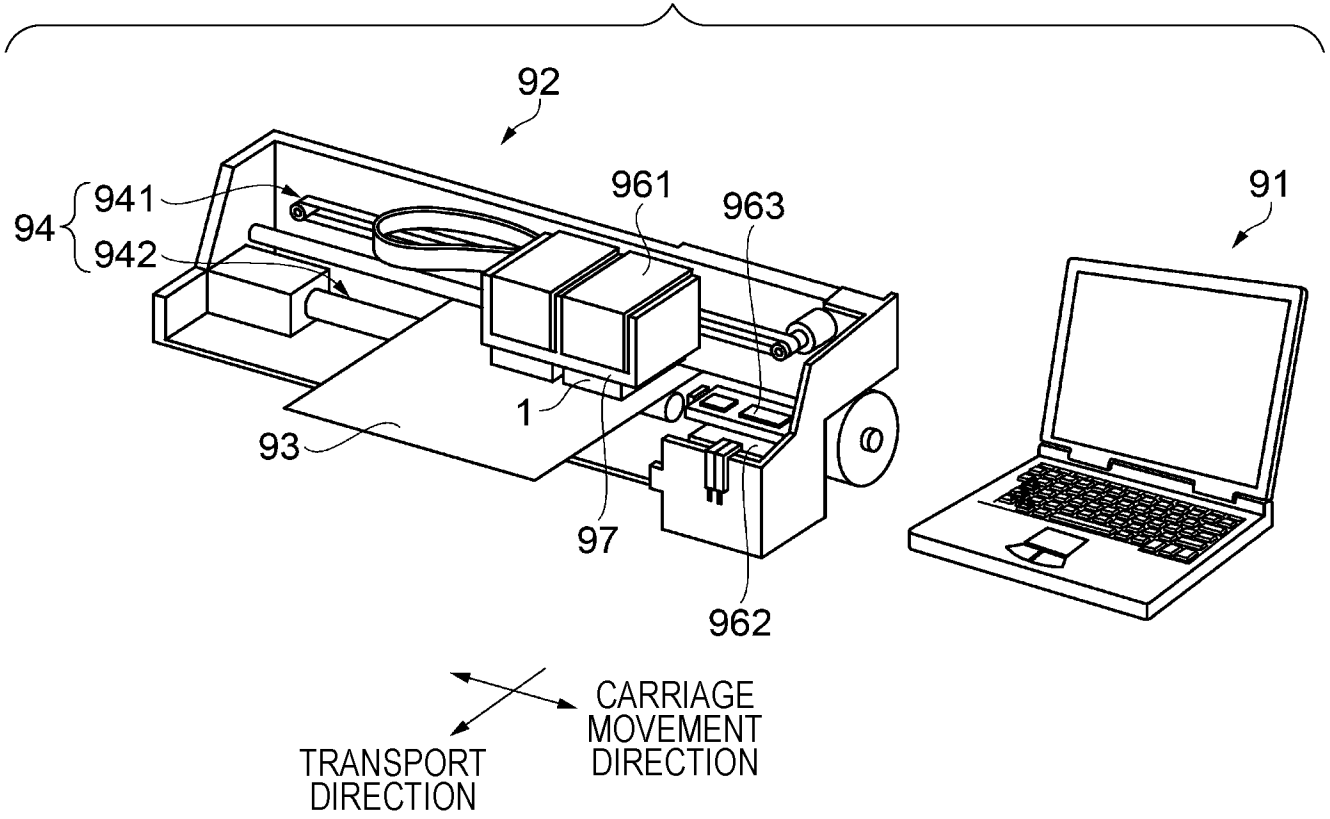
FIG. 1 is an explanatory diagram showing a schematic configuration of a droplet discharge apparatus according to Embodiment 1.

FIG. 1 is a diagram showing a schematic configuration of a droplet discharge apparatus according to Embodiment 1.

Schematic Configuration of Droplet Discharge Apparatus

FIG. 1 is a diagram showing a schematic configuration of a computer 91 as a droplet discharge control apparatus and a printer 92 as a droplet discharge apparatus that constitute a printing system. The printer 92 prints an image on a recording medium 93 such as paper, cloth, or film. The computer 91 is communicably coupled to the printer 92. The computer 91 outputs print data corresponding to the image to the printer 92, and the printer 92 prints the image on the recording medium 93. Computer programs such as application programs and printer drivers are installed on the computer 91.

The printer 92 includes a head unit 1, a transport mechanism 94, a control unit 95, a first tank 961, and a second tank 962. The control unit 95 will be described later.

Figure 2:
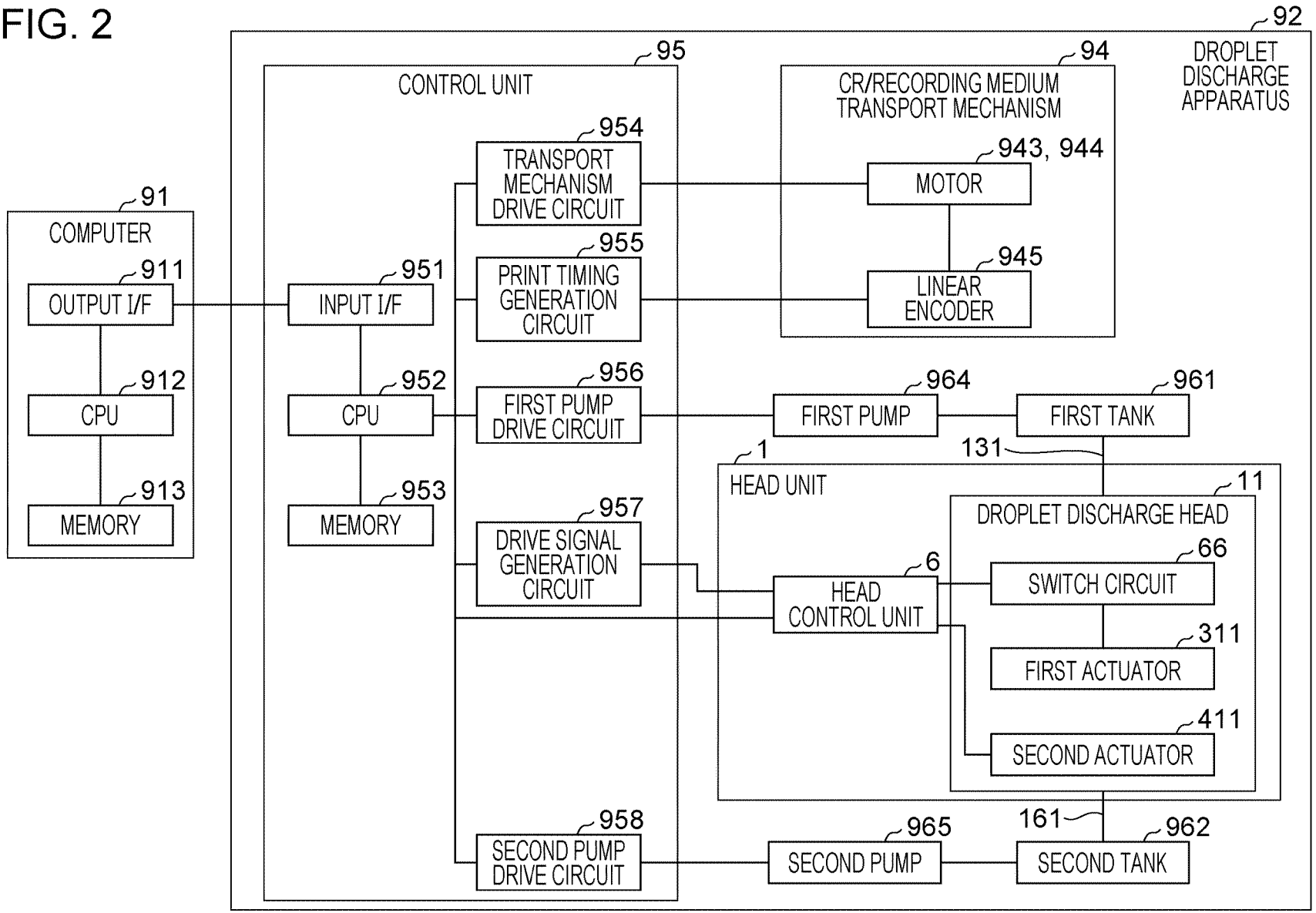
FIG. 2 is a block diagram showing a schematic configuration of the droplet discharge apparatus according to Embodiment 1.

The head unit 1 includes a head control unit 6 and a droplet discharge head 11 (see FIG. 2). In the droplet discharge head 11, a plurality of nozzles are arranged on the surface of a carriage 97 facing the recording medium 93 so as to intersect a carriage movement direction and discharge a liquid to the recording medium 93. The liquid may be a material in a state when a substance is in a liquid phase, and a liquid state material such as sol or gel is also included in the liquid. The liquid includes not only a liquid as one state of a substance but also a liquid in which particles of a functional material made of a solid such as a pigment or metal particles are dissolved, dispersed or mixed in a solvent. For example, ink, liquid crystal emulsifier, metal paste and the like can be mentioned. The head control unit 6 is provided inside the carriage 97 and is electrically coupled to the control unit 95. The head control unit 6 is a control unit that controls the discharge of droplets from the droplet discharge head 11. The head control unit 6 will be described later.

The transport mechanism 94 includes a carriage moving mechanism 941 and a recording medium transport mechanism 942. The carriage moving mechanism 941 drives a motor 943 to move the carriage 97 including the head unit 1 in a carriage moving direction (see FIG. 2). The carriage 97 reciprocates in the carriage movement direction, and the droplet discharge head 11 discharges a liquid based on the print data so that the printer 92 prints an image on the recording medium 93. The recording medium transport mechanism 942 transports the recording medium 93 in a transport direction by the motor 944 (see FIG. 2). This transport direction is a direction that intersects the carriage movement direction.

The first tank 961 stores the liquid supplied to the droplet discharge head 11 through a first inflow path 131. The first tank 961 also has a first pump 964. The first pump 964 pressurizes the liquid flowing through the first inflow path 131 by pressurizing the inside of the first tank 961. The liquid supplied to the droplet discharge head 11 is discharged onto the recording medium 93 by driving a first actuator 311 and a second actuator 411 in the droplet discharge head 11 (see FIG. 2).

The second tank 962 stores a liquid that is not discharged from the droplet discharge head 11 to the recording medium 93 through an outflow path 161. The second tank 962 also has a second pump 965. The second pump 965 sucks the liquid from the droplet discharge head 11 through the outflow path 161 by depressurizing the inside of the second tank 962. Either one of the first pump 964 and the second pump 965 may be omitted (see FIG. 2).

The outflow path 161 of Embodiment 1 has a cap 963 that contacts the droplet discharge head 11. The second pump 965 depressurizes the inside of the cap 963 through the second tank 962 and sucks the thickened liquid from the droplet discharge head 11. Thereby, the droplet discharge head 11 can suppress accumulation of sediment components in the liquid.

Block Diagram of Droplet Discharge Apparatus

FIG. 2 is a block diagram showing a schematic configuration of the computer 91 and the printer 92. First, the configuration of the computer 91 will be briefly described. The computer 91 includes an output interface 911 (output IF), a CPU 912, and a memory 913.

The output IF 911 exchanges data with the printer 92. The CPU 912 is an arithmetic processing apparatus for performing overall control of the computer 91. The memory 913 includes a RAM, an EEPROM, a ROM, a magnetic disk apparatus, and the like and stores a computer program used by the CPU 912. Computer programs stored in the memory 913 include application programs and printer drivers. The CPU 912 performs various controls according to the computer program.

The printer driver is a program that converts image data into print data. This print data is output to the printer 92. The print data is data in a format that can be interpreted by the printer and includes various command data and pixel data (SI). The command data is data for instructing the printer to execute a specific operation. The command data includes, for example, command data for instructing paper feed, command data for indicating a transport amount, and command data for instructing paper discharge. Pixel data (SI) is data relating to pixels of an image to be printed.

Here, a pixel is a unit element constituting an image, and an image is formed by arranging these pixels in a two-dimensional manner. Pixel data (SI) in the print data is data (for example, gradation values) relating to dots formed on the recording medium 93.

Next, the configuration of the control unit 95 inside the printer 92 will be briefly described. The control unit 95 includes an input interface 951 (input IF), a CPU 952, a memory 953, a drive signal generation circuit 957, a transport mechanism drive circuit 954, a print timing generation circuit 955, a first pump drive circuit 956, a second pump drive circuit 958. The input IF 951 exchanges data with the computer 91 which is an external apparatus. The CPU 952 is an arithmetic processing device for performing overall control of the printer 92. The memory 953 includes a RAM, an EEPROM, a ROM, a magnetic disk apparatus, and the like and stores a computer program used by the CPU 952. The CPU 952 controls each circuit in accordance with a computer program stored in the memory 953.

The computer program includes a drive signal generation program, a transport mechanism drive program, a print timing generation program, a first pump drive program, a second pump drive program, and the like.

The drive signal generation circuit 957 generates a drive signal when a clock signal (CK) is input. The drive signal generation circuit 957 periodically generates two or more types of drive signals and outputs the signals to the head control unit 6.

The transport mechanism drive circuit 954 controls the transport amount of the transport mechanism 94 via the motors 943 and 944 and the like. For example, the motor 943 of the carriage moving mechanism 941 is rotated to transport the carriage 97 in the carriage movement direction. At this time, a linear encoder 945 attached to the motor 943 calculates the transport amount of the carriage 97 from a rotation amount of the motor 943 and outputs the amount to the print timing generation circuit 955. The print timing generation circuit 955 generates a clock signal (CK) based on the transport amount and outputs the signal to the head control unit 6 and the transport mechanism drive circuit 954.

The first pump drive circuit 956 drives the first pump 964 to control the pressure in the first tank 961. Similarly, the second pump drive circuit 958 drives the second pump 965 to control the pressure in the second tank 962. The second pump 965 depressurizes the inside of the second tank 962 when the droplet discharge head 11 is cleaned and sucks the thickened liquid (ink) from the droplet discharge head 11.

Schematic Configuration of Droplet Discharge Head

Figure 3A:
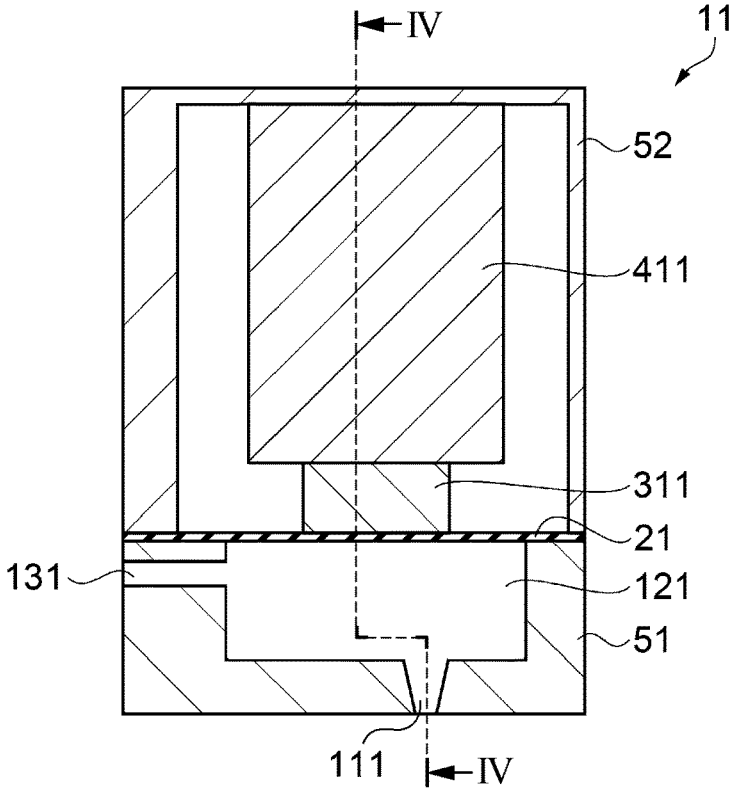
FIG. 3A is a diagram showing an operation of a droplet discharge head according to Embodiment 1.
Figure 4:
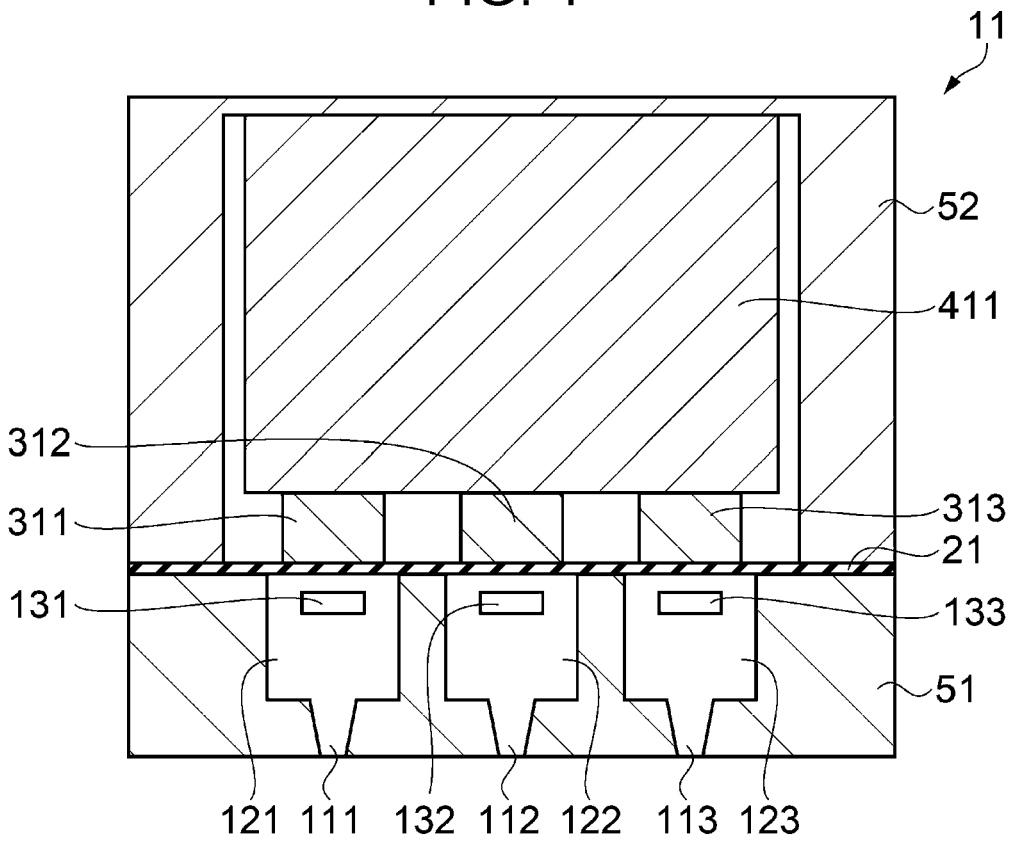
FIG. 4 is a cross-sectional diagram of the droplet discharge head of FIG. 3A as viewed from the IV-IV direction.

FIG. 3A is a diagram showing a schematic configuration of the droplet discharge head 11 according to Embodiment 1. FIG. 4 is a cross-sectional diagram of the droplet discharge head 11 of FIG. 3A as viewed from the IV-IV direction. The droplet discharge head 11 includes a flow path forming substrate 51, a first vibration plate 21, a first actuator 311 and a second actuator 411. In the flow path forming substrate 51, the nozzle 111, the first liquid chamber 121, and the first inflow path 131 are formed.

The first liquid chamber 121 is a space formed by forming a recess in the flow path forming substrate 51 and sealing the opening of the recess with the first vibration plate 21. The first liquid chamber 121 communicates with the first inflow path 131 for supplying the liquid to the first liquid chamber 121 and the nozzle 111 for discharging the liquid to the outside.

The first vibration plate 21 is fixed to the flow path forming substrate 51 and constitutes a part of the wall surface of the first liquid chamber 121. The first vibration plate 21 is a plate-like member (diaphragm) that is configured to be bent and deformed in a first direction and a second direction opposite to the first direction. Here, the first direction refers to a direction in which the first vibration plate 21 is displaced so as to reduce the volume of the first liquid chamber 121, and the second direction refers to a direction in which the first vibration plate 21 is displaced so as to increase the volume of the first liquid chamber 121.

The first actuator 311 and the second actuator 411 are disposed on the first vibration plate 21. More specifically, the first actuator 311 is sandwiched between the first vibration plate 21 and the second actuator 411 and is mechanically coupled to each. The second actuator 411 is fixed to the lid member 52. Since the rigidity of the lid member 52 is higher than that of the first vibration plate 21, the first vibration plate 21 is displaced in the first direction or the second direction as the first actuator 311 and the second actuator 411 expand and contract. Here, the second actuator 411 displaces the first vibration plate 21 by displacing the first actuator 311. In this way, the first actuator 311 and the second actuator 411 can apply the pressure of the first liquid chamber via the same vibration plate, and the responsiveness of the liquid in the nozzle to the pressure change generated by the second actuator 411 is improved.

In Embodiment 1, the first actuator 311 and the second actuator 411 are configured by piezoelectric elements that expand and contract in accordance with an applied voltage. The first vibration plate 21, the first actuator 311, the second actuator 411, and the lid member 52 may be fixed via islands or electrodes.

The second actuator 411 is fixed to a plurality of the first actuators 311, 312, and 313. The expansion/contraction amount of the second actuator 411 is larger than that of the first actuators 311, 312, and 313. Thus, even when the area of the surface of the second actuator 411 that displaces the first vibration plate 21 is large, since the plurality of first actuators 311, 312, and 313 can be arranged on the surface of the second actuator 411 that displaces the first vibration plate 21, the nozzles 111, 112, and 113 can be arranged with high density.

Description of Head Control Unit 6

Figure 5:
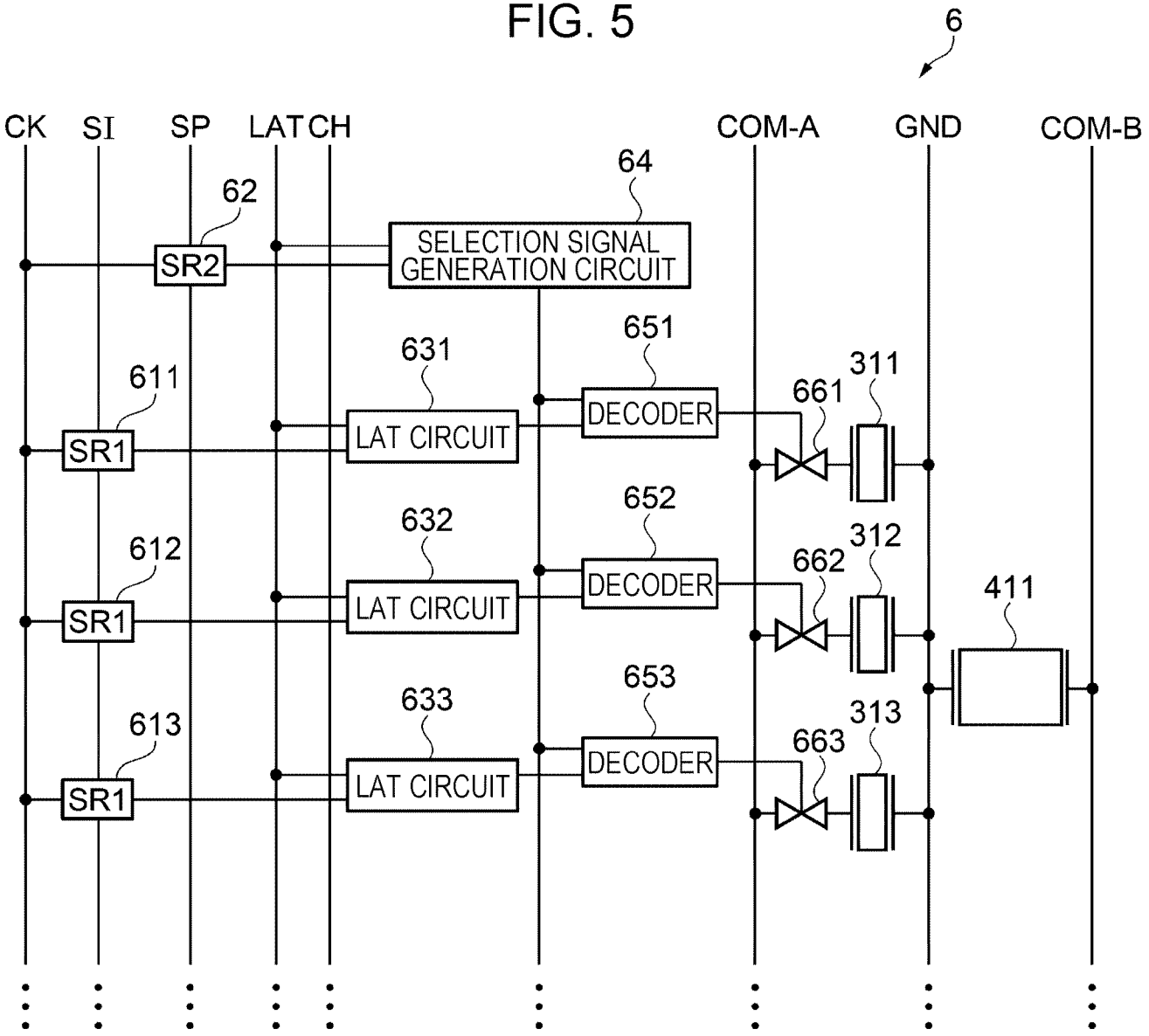
FIG. 5 is a block diagram showing a schematic configuration of a head control unit according to Embodiment 1.

FIG. 5 is a block diagram showing a schematic configuration of the head control unit 6 according to Embodiment 1. The head control unit 6 includes a first shift register 61 (SR1), a second shift register 62 (SR2), an LAT circuit 63, a selection signal generation circuit 64, a decoder 65, and a switch circuit 66. The switch circuits 661, 662, and 663 are coupled to the first actuators 311, 312, and 313, respectively.

The head control unit 6 receives a clock signal (CK), a latch signal (LAT), a change signal (CH), a first drive signal (COM-A), a second drive signal (COM-B), and a setting signal including pixel data (SI) and setting data (SP) from the control unit 95. The first drive signal (COM-A) is applied to the first actuators 311, 312, and 313, and the second drive signal (COM-B) is applied to the second actuator 411.

When the setting signal is input to the head control unit 6 in synchronization with the clock signal (CK), pixel data (SI) is set in the first shift register 611, 612, and 613 (SR1), and setting data (SP) is set in the second shift register 62 (SR2). In accordance with the pulse of the latch signal (LAT), the pixel data (SI) is latched in the LAT circuits 631, 632, and 633, and the setting data (SP) is latched in the selection signal generation circuit 64, respectively.

The selection signal generation circuit 64 generates a plurality of selection signals based on the setting data (SP) and the change signal (CH). The decoder 65 selects one of the plurality of selection signals input from the selection signal generation circuit 64 in accordance with the pixel data (SI) latched in the LAT circuits 631, 632, and 633. The selected selection signal is output from the decoders 651, 652, and 653 as a switch signal.

The first drive signal (COM-A) and the switch signal are input to the switch circuits 661, 662, and 663. For example, when the switch signal is at an H level, the switch circuit 661 is turned on, and the first drive signal (COM-A) is applied to the first actuator 311. When the switch signal is at an L level, the switch circuit 661 is turned off, and the first drive signal (COM-A) is not applied to the first actuator 311.

On the other hand, since the second actuator 411 is driven periodically regardless of discharged or non-discharge, the second drive signal (COM-B) is periodically applied to the second actuator 411.

Next, discharge control and non-discharge control methods will be described. In Embodiment 1, since the second actuator 411 is fixed to the plurality of first actuators 311, 312, and 313 as shown in FIG. 4, the drive control of the second actuator 411 is the same in a discharge nozzle that discharges the liquid and a non-discharge nozzle that does not discharge the liquid. Here, the control method will be described below assuming that the nozzle 111 is a discharge nozzle as a first nozzle and the nozzle 112 is a non-discharge nozzle as a second nozzle.

Droplet Discharge Control

Figure 6A:
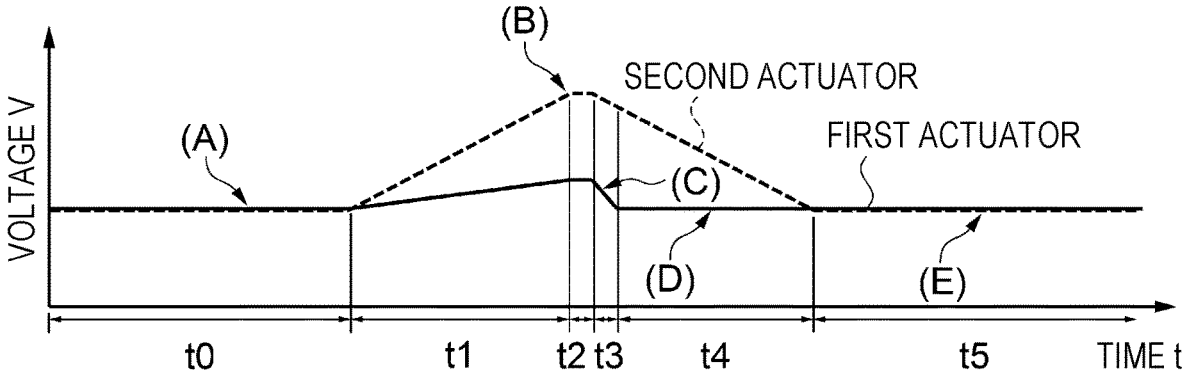
FIG. 6A is a timing chart of droplet discharge control according to Embodiment 1.

FIG. 6A is an example of a timing chart (solid line) of the first actuator 311 executed based on the first drive signal (COM-A) input from the switch circuit 661 and a timing chart (broken line) of the second actuator 411 executed based on the second drive signal (COM-B). The horizontal axis in FIG. 6A indicates the elapsed time, and the vertical axis indicates the voltage applied to the first actuator 311 and the second actuator 411. When a positive voltage is applied to the actuator, the first actuator 311 and the second actuator 411 contract to expand the volume of the first liquid chamber 121. This timing chart represents a series of droplet discharge control for discharging a liquid from the nozzle 111 as droplets.

FIGS. 3A to 3E are diagrams showing the operation of the droplet discharge head 11 associated with the droplet discharge control, and FIGS. 7A to 7E are cross-sectional diagrams showing the change of the meniscus over time in the nozzle 111 associated with the droplet discharge control. The cross section is a plane including the central axis C of the nozzle 111. The alphabet (A to E) of each drawing number in FIGS. 3A to 3EG and FIGS. 7A to 7E corresponds to the alphabet (A to E) described in FIG. 6A.

As shown in FIG. 6A, the droplet discharge head 11 executes six processes of each period t0 to t5 in a series of discharge control. The period t0 is an initial state standby process in which an intermediate potential is applied to the first actuator 311 and the second actuator 411. The period t1 is a drawing process in which the first actuator 311 and the second actuator 411 displace the first vibration plate 21 in the second direction and draw the meniscus in the nozzle 111 toward the first liquid chamber 121. The period t2 is a standby process in which the first actuator 311 and the second actuator 411 hold the position of the first vibration plate 21. The period t3 is a liquid column forming process in which the first actuator 311 and the second actuator 411 displace the first vibration plate 21 in the first direction, reverse the meniscus in the nozzle 111, and form a liquid column. The period t4 is a pushing process for displacing the first vibration plate 21 in the first direction until the second actuator 411 reaches the intermediate potential. In the period t3 or the period t4, the liquid column is separated from the liquid in the nozzle 111 and discharged as droplets. The period t5 is a refilling process in which the first actuator 311 and the second actuator 411 hold the position of the first vibration plate 21 and the liquid is supplied from the first inflow path 131 to the nozzle 111 via the first liquid chamber 121.

Figure 7A:
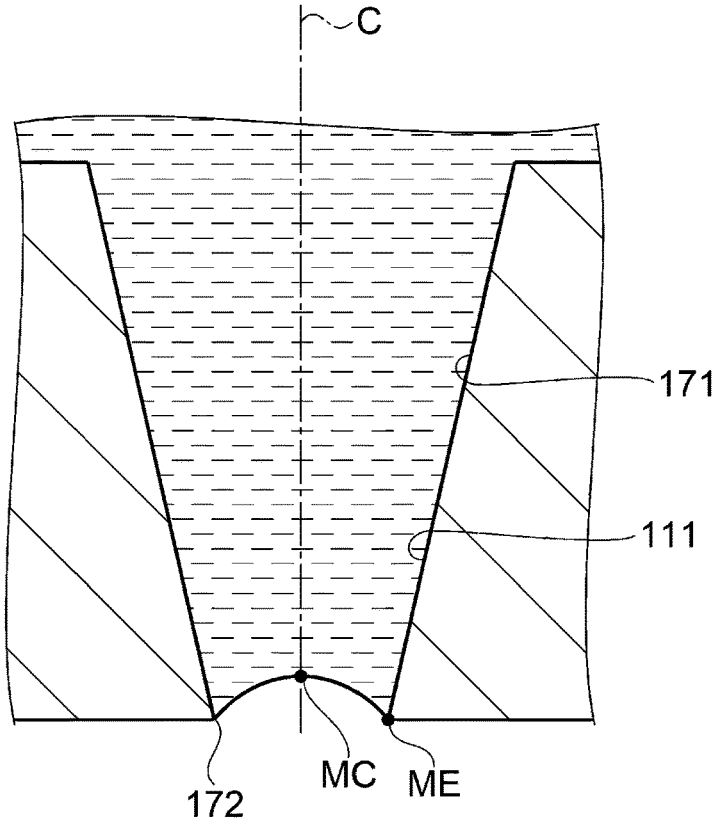
FIG. 7A is a cross-sectional diagram showing a change of a meniscus over time in a nozzle.

In the initial state standby process in the period t0, the liquid in the nozzle 111 before the discharge control is started is maintained at a meniscus pressure resistance or lower. At this time, as shown in FIG. 7A, a boundary ME between the nozzle wall surface 171 and the meniscus is located in the opening 172 of the nozzle 111, and a meniscus MC of the central axis C of the nozzle 111 is located on the first liquid chamber 121 side in the nozzle 111 due to surface tension. This state is defined as a stable state.

Figure 3B:
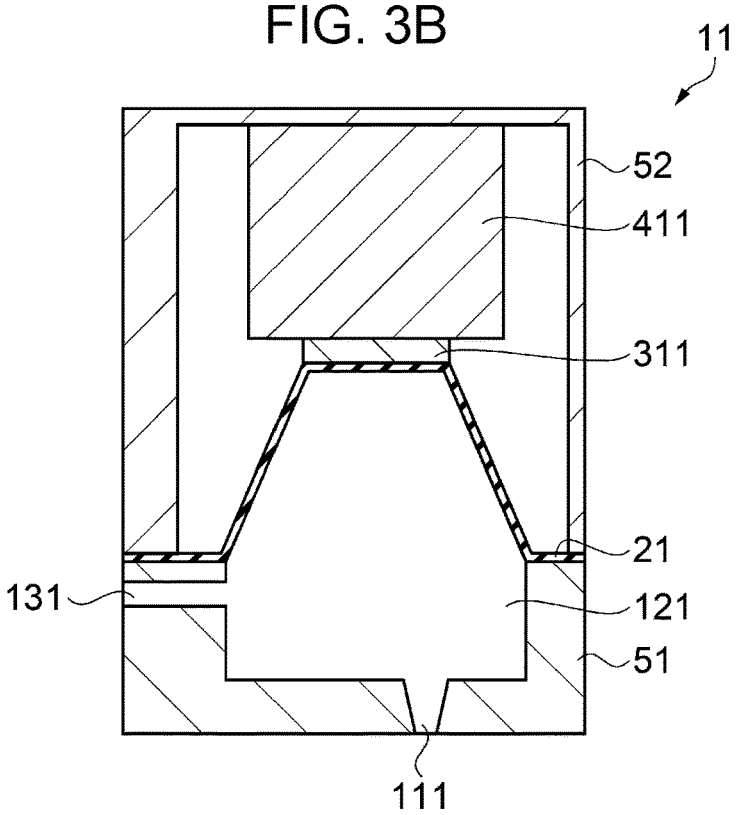
FIG. 3B is a diagram showing the operation of the droplet discharge head according to Embodiment 1.
Figure 7B:
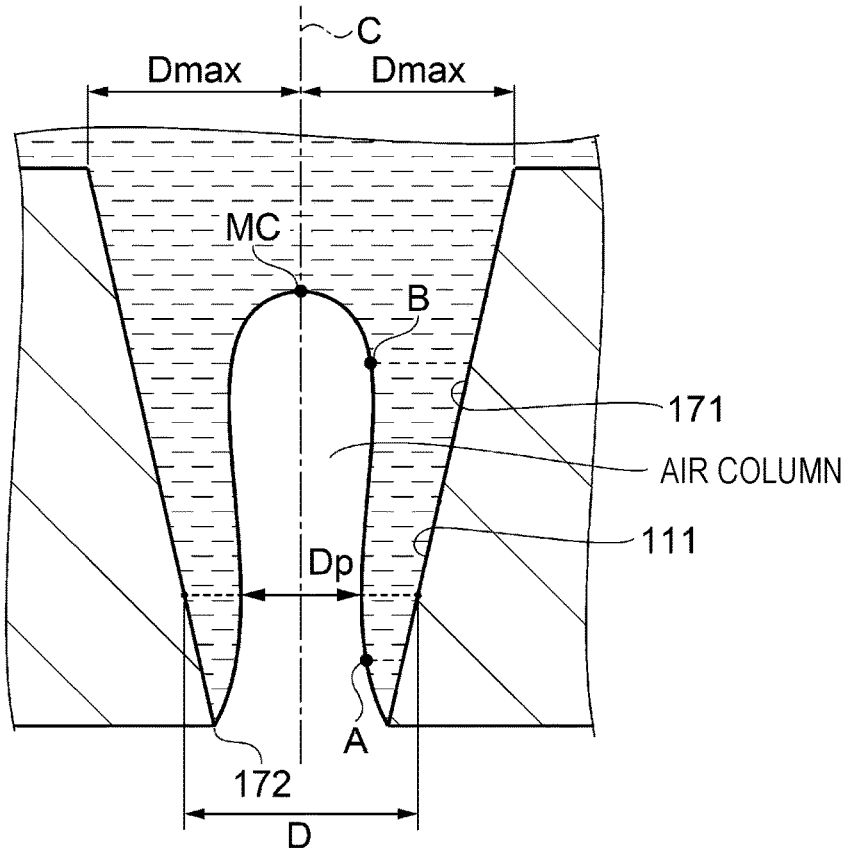
FIG. 7B is a cross-sectional diagram showing the change of the meniscus over time in the nozzle.

In the drawing process in the period t1, the first actuator 311 and the second actuator 411 contract and the first vibration plate 21 is displaced in the second direction (FIG. 3B). As a result, the volume of the first liquid chamber 121 increases, and the pressure in the first liquid chamber 121 decreases. In this drawing step, the liquid at the center of the nozzle 111 is drawn to the first liquid chamber 121 side, and the liquid on the nozzle wall surface 171 remains in place with a predetermined thickness. This is due to the fact that a large frictional force acts in the region near the boundary surface between the solid and the liquid (the boundary between the nozzle wall surface 171 and the liquid), and the flow rate decreases due to the influence of viscosity. The influence of the interface on the liquid increases as the viscosity of the liquid increases. Therefore, when the first liquid chamber 121 is depressurized and the flow rate toward the first liquid chamber 121 is generated in the liquid in the nozzle 111, the liquid stays on the nozzle wall surface 171, and the liquid at the center of the nozzle 111 having a small influence of the boundary surface is drawn to form a pseudo nozzle that is slightly smaller than the diameter of the nozzle 111 (FIG. 7B). Here, the diameter of the nozzle 111 indicates a distance between the nozzle wall surfaces 171 facing each other via the nozzle 111 center axis C on a plane having the nozzle 111 center axis C as a normal line.

As shown in FIG. 7B, a thickness tm of the liquid remaining on the nozzle wall surface 171 is an average thickness obtained by the following method. First, the state of the liquid in the nozzle 111 is imaged by a stroboscope from the side of the nozzle 111, and in the obtained two-dimensional image, a portion of the curve that satisfies any of the following conditions (i) to (iii) is obtained from the curves represented by the meniscus. (i) The center of curvature of the meniscus is located on the nozzle wall surface 171 side with respect to the meniscus. (ii) The radius of curvature of the meniscus is infinite. The infinite radius of curvature of the meniscus means that the radius of curvature of the meniscus is two or more orders of magnitude larger than the diameter of the opening 172 of the nozzle 111. (iii) The center of curvature of the meniscus is located on the center axis C side of the nozzle 111 with respect to the meniscus, and the radius of curvature of the meniscus is larger than a maximum radius Dmax of the nozzle 111. The end portion on the opening 172 side of the nozzle 111 in the portion of the curve thus obtained is set as a point A, and the end portion on the first liquid chamber 121 side is set as a point B. The average of the distance between the meniscus of the curve between the points A and B on the surface having the central axis C of the nozzle 111 as a normal line and the nozzle wall surface 171 is defined as the liquid thickness tm. When the meniscus is seen from the opening 172 side of the nozzle 111, the diameter of the pseudo nozzle is defined by a diameter Dp that minimizes the distance between the meniscuses facing each other via the nozzle 111 center axis C on the surface having the center axis C of the nozzle 111 as a normal line in the curve between the points A and B. This diameter Dp is taken as the diameter of the pseudo nozzle. The diameter Dp is preferably less than two-thirds of the diameter of the nozzle 111 on a plane normal to the central axis C of the nozzle 111 including the diameter Dp and is more preferably one-fourth or more and less than two-thirds of the diameter of the nozzle 111.

In the standby step in the period t2, since the head control unit 6 holds the applied voltage of the first actuator 311 and the second actuator 411 constant, the position of the first vibration plate 21 is kept. During this time, the pressure wave generated by driving the first actuator 311 and the second actuator 411 during the period t1 reciprocates at a natural frequency Tc of the first liquid chamber 121.

Figure 3C:
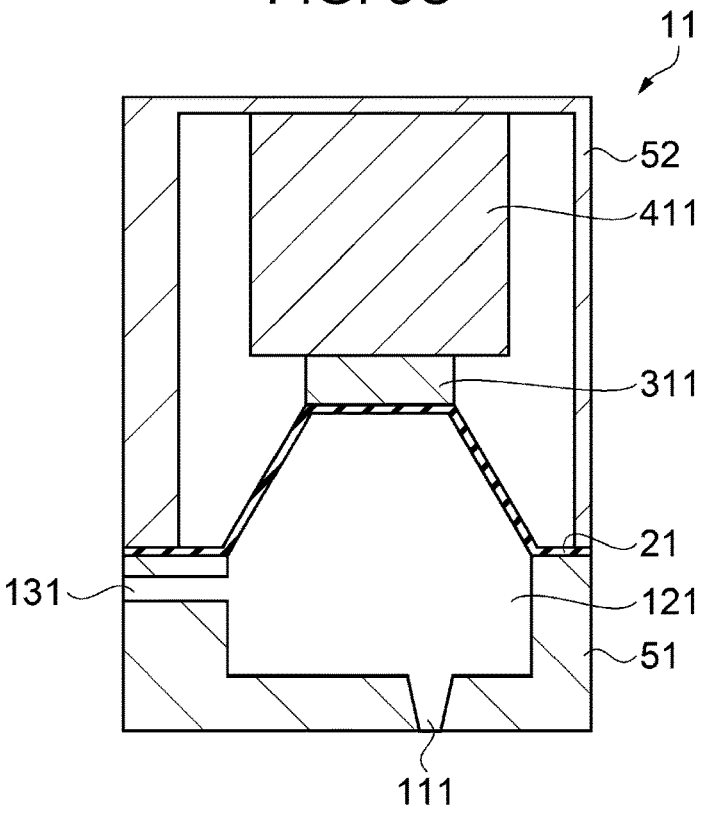
FIG. 3C is a diagram showing the operation of the droplet discharge head according to Embodiment 1.
Figure 7C:
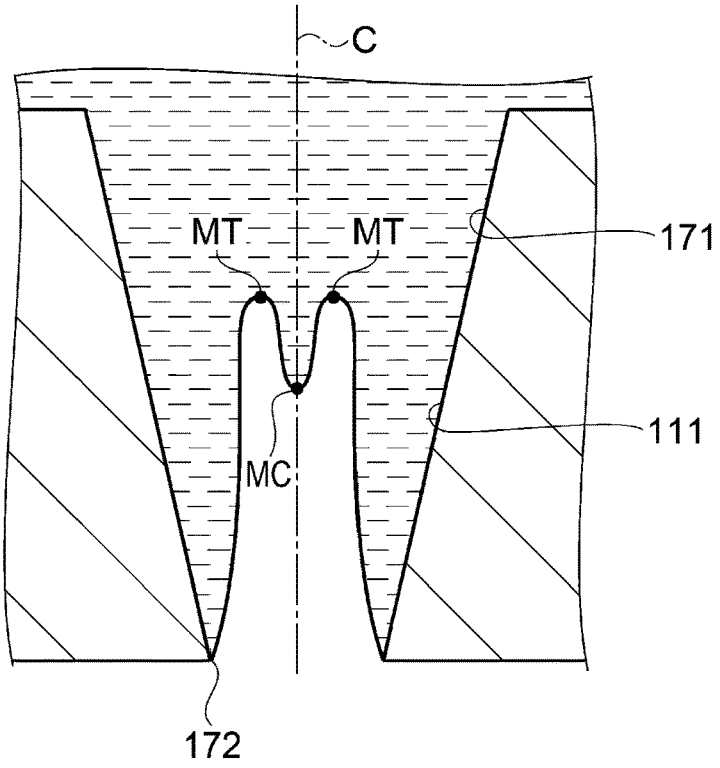
FIG. 7C is a cross-sectional diagram showing the change of the meniscus over time in the nozzle.

In the liquid column forming step in the period t3, the first actuator 311 and the second actuator 411 are extended, whereby the first vibration plate 21 is displaced in the first direction (FIG. 3C). Due to the rapid extension of the first actuator 311, a large amount of energy is instantaneously applied to the liquid in the first liquid chamber 121 to generate a pressure wave. Since this pressure wave propagates from the first liquid chamber 121 to the liquid in the nozzle 111, the meniscus MC of the central axis C of the nozzle 111 is reversed to the opening 172 side of the nozzle 111 to form a liquid column (FIG. 7C). Here, the liquid column refers to a range from a vertex MC of the inverted meniscus to an extreme value MT where the meniscus protrudes toward the first liquid chamber 121. At this time, it is preferable that the pressure wave generated in the period t3 and the pressure wave generated in the period t2 interfere with each other in the same phase. Thereby, a larger pressure can be applied to the liquid in the nozzle 111.

Figure 3D:
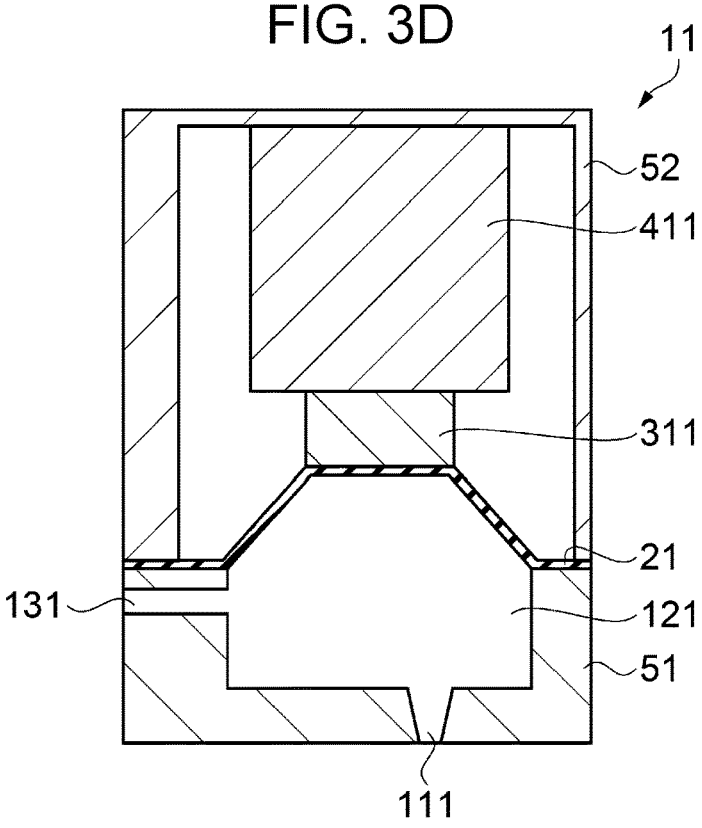
FIG. 3D is a diagram showing the operation of the droplet discharge head according to Embodiment 1.
Figure 3E:
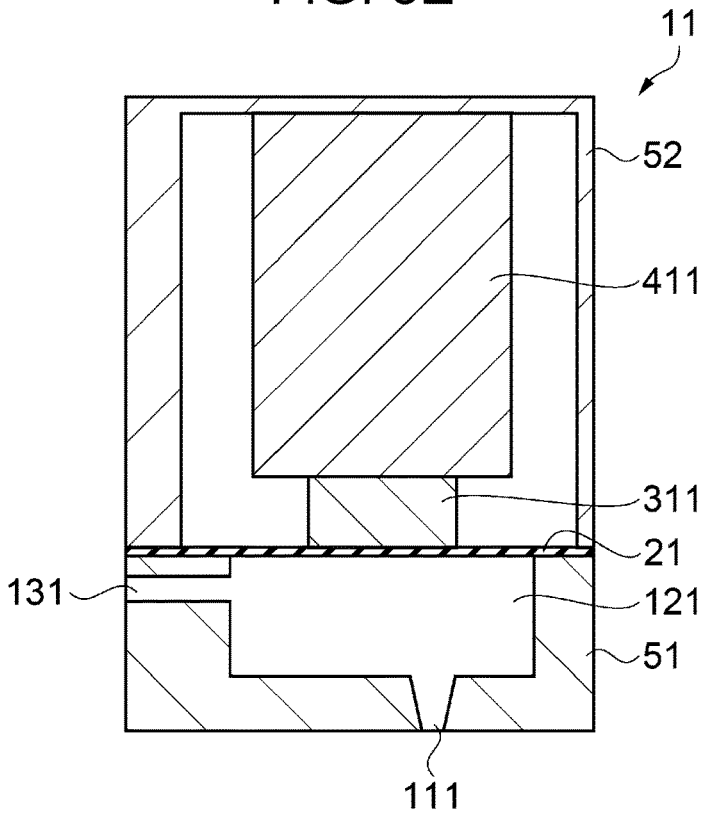
FIG. 3E is a diagram showing the operation of the droplet discharge head according to Embodiment 1.

In the pushing process in the period t4, the first vibration plate 21 is displaced in the first direction by the second actuator 41 extending until the second actuator 41 reaches an intermediate potential (FIG. 3D). In Embodiment 1, the first actuator 311 reaches the intermediate potential in the period t3.

Figure 7D:
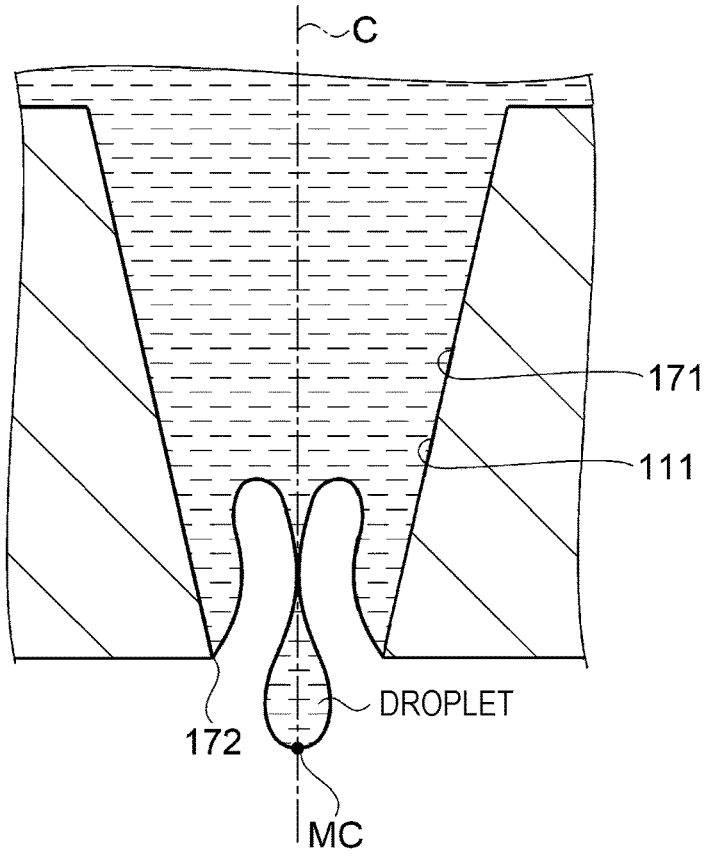
FIG. 7D is a cross-sectional diagram showing the change of the meniscus over time in the nozzle.
Figure 7E:
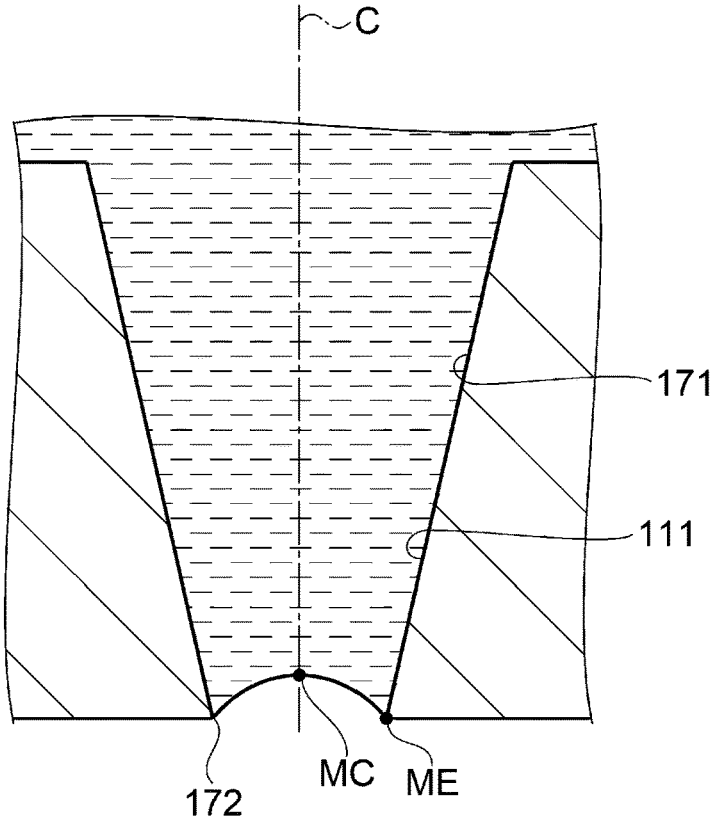
FIG. 7E is a cross-sectional diagram showing the change of the meniscus over time in the nozzle.

In at least one of the period t3 and the period t4, the liquid in the nozzle 111 is pressurized by the displacement of the first vibration plate 21 in the first direction. The pressurized liquid in the nozzle 111 concentrates on the liquid column and selectively pressurizes only the liquid column. This is because a pseudo-nozzle is formed at the center of the nozzle 111, and the channel resistance at the center of the nozzle 111 is smaller than the channel resistance of the nozzle wall surface 171. Thereby, the speed at which the liquid column moves in the direction toward the opening 172 of the nozzle 111 is higher than the speed at which the extreme value MT of the meniscus moves in the direction toward the opening 172 of the nozzle 111. When the total energy applied to the liquid column exceeds the energy that separates the liquid column from the meniscus, the liquid column is discharged as a droplet from the opening 172 of the nozzle 111 (FIG. 7D). In FIG. 6A, the droplets are separated from the liquid in the nozzle 111 by the pressurization of the liquid in the pushing process. When the energy for separating the liquid column from the meniscus in the liquid column forming process is applied from the first actuator 311 and the second actuator 411, the pressurization of the liquid in the pushing step may be for returning the meniscus to the stable state.

In the refilling process in the period t5, the position of the first vibration plate 21 is maintained. At this time, the meniscus in the nozzle 111 returns to the stable state by supplying the liquid from the first inflow path 131.

Non-Discharge Control

Figure 6B:
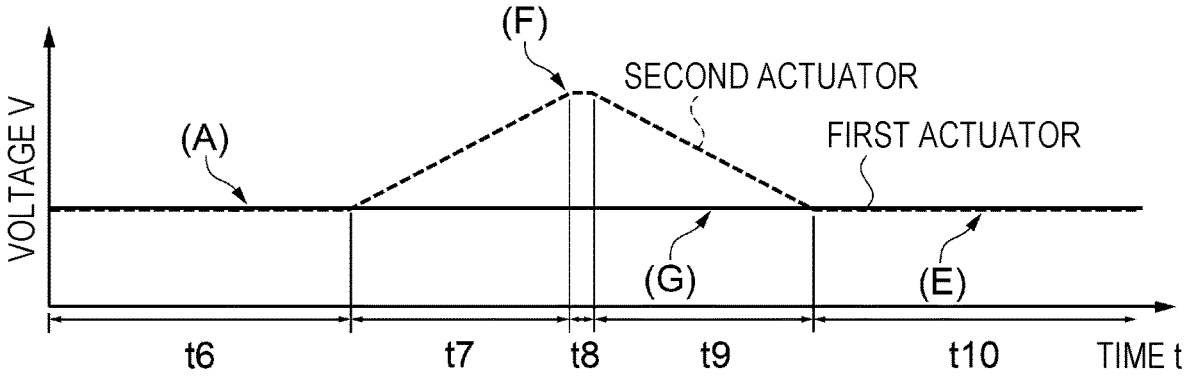
FIG. 6B is a timing chart of non-discharge control according to Embodiment 1.

FIG. 6B is an example of a timing chart (solid line) of the first actuator 312 executed based on the first drive signal (COM-A) input from the switch circuit 662 and a timing chart (broken line) of the second actuator 411 executed based on the second drive signal (COM-B). The horizontal and vertical axes in FIG. 6B are the same as in FIG. 6A. This timing chart represents a series of non-discharge controls in which the liquid is not discharged from the nozzle 112 as droplets.

FIGS. 3A, 3F, 3G, and 3E are diagrams showing the operation of the droplet discharge head 11 accompanying non-discharge control, and FIGS. 7A, 7F, 7G, and 7E are cross-sectional diagrams showing the change of the meniscus over time in the nozzle 112 in due to the non-discharge control. The alphabet (A, F, G, and E) of each drawing number in FIGS. 3A, 3F, 3G, 3E and 7A, 7F, 7G, and 7E corresponds to the alphabet (A, F, G, and E) described in FIG. 6B.

As shown in FIG. 6B, the droplet discharge head 11 executes five processes t6 to t10 in a series of non-discharge control. The period t6 is an initial state standby process. The period t7 is a drawing process. The period t8 is a standby process. The period t9 is a pushing process. The period t10 is a refilling process. Since the period t6 and the period t10 are the same control method as droplet discharge control, description thereof is omitted.

Figure 3F:
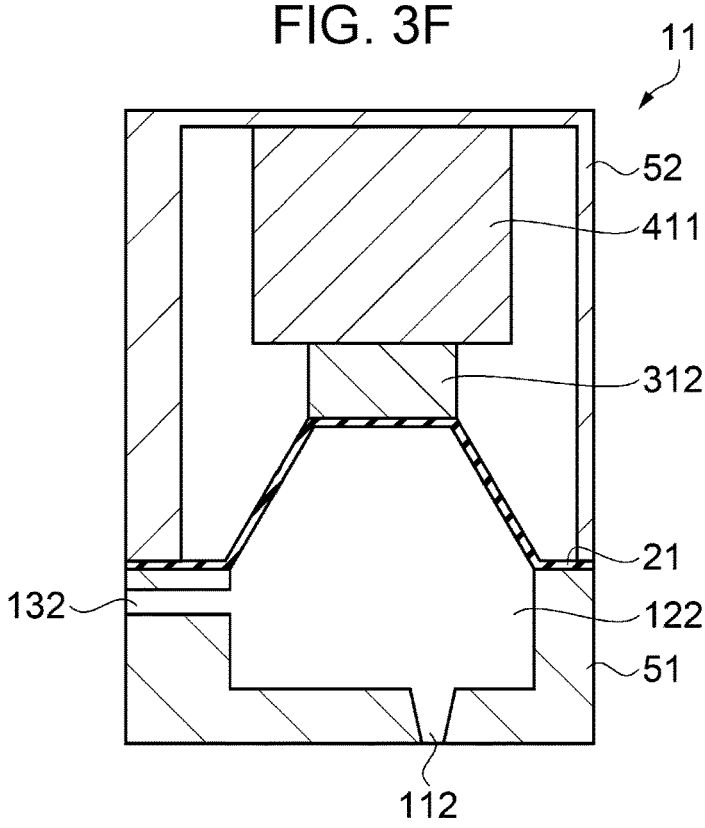
FIG. 3F is a diagram showing the operation of the droplet discharge head according to Embodiment 1.
Figure 7F:
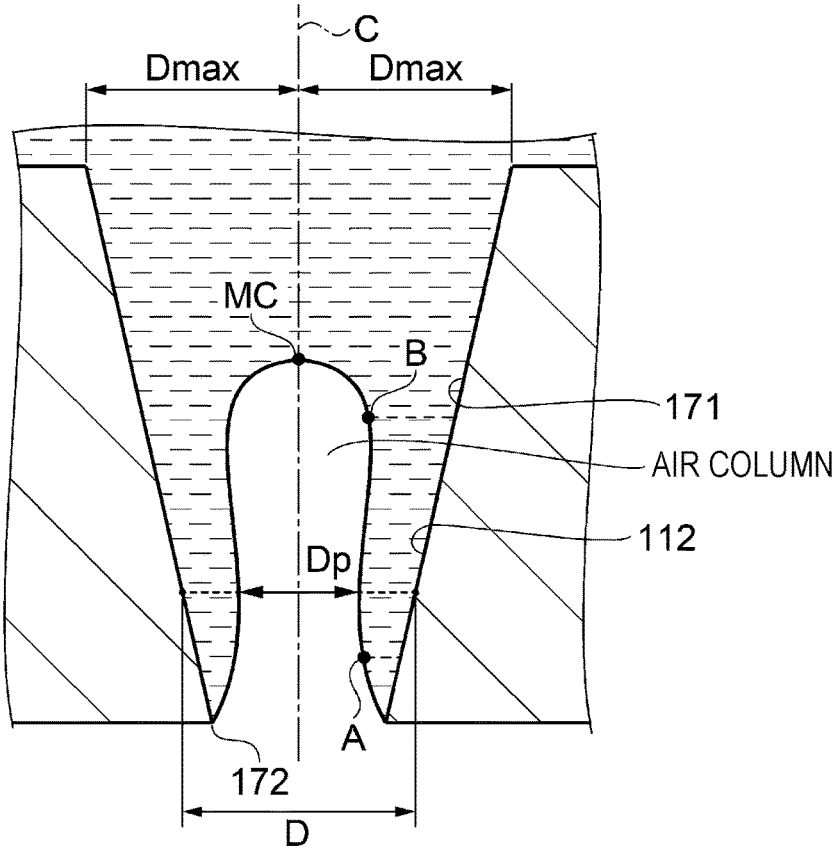
FIG. 7F is a cross-sectional diagram showing the change of the meniscus over time in the nozzle.

In the drawing process in the period t7, the second actuator 411 contracts to displace the first vibration plate 21 in the second direction (FIG. 3F). As a result, the volume of the first liquid chamber 122 is increased, and the pressure in the first liquid chamber 122 is reduced. In this drawing process, the liquid at the center of the nozzle 112 is drawn to the first liquid chamber 122 side, and the liquid on the nozzle wall surface 171 remains in place with a predetermined thickness. However, since the first actuator 312 is not driven, the amount of liquid at the center of the nozzle 112 drawn into the first liquid chamber 122 is equal to or less than the drawing process (FIG. 7B) in the period t1 (FIG. 7F).

In the standby step in the period t8, since the head control unit 6 holds the applied voltage of the first actuator 312 and the second actuator 411 constant, the position of the first vibration plate 21 is kept.

Figure 3G:
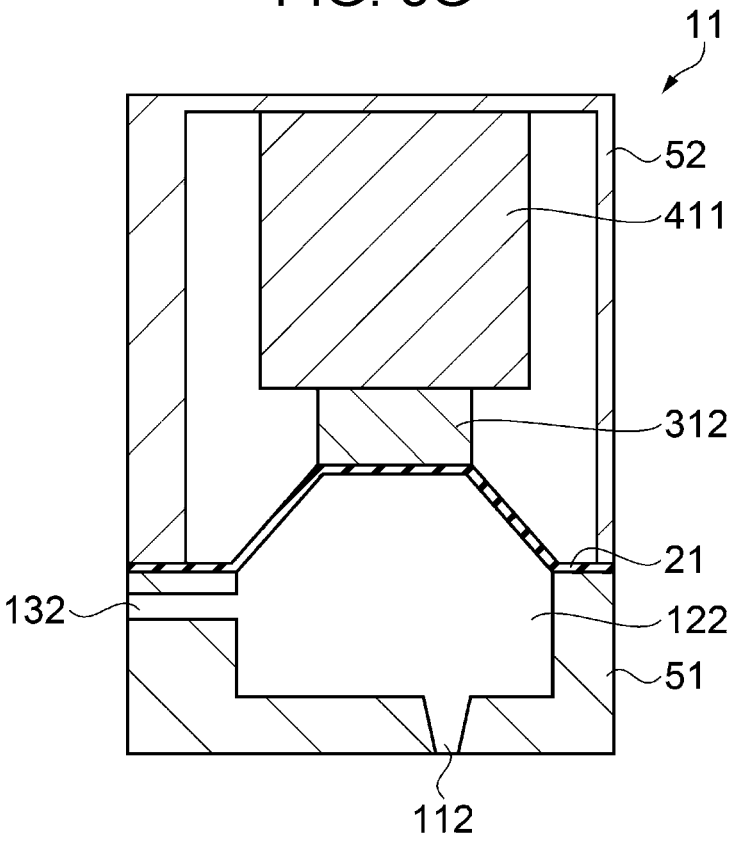
FIG. 3G is a diagram showing the operation of the droplet discharge head according to Embodiment 1.
Figure 7G:
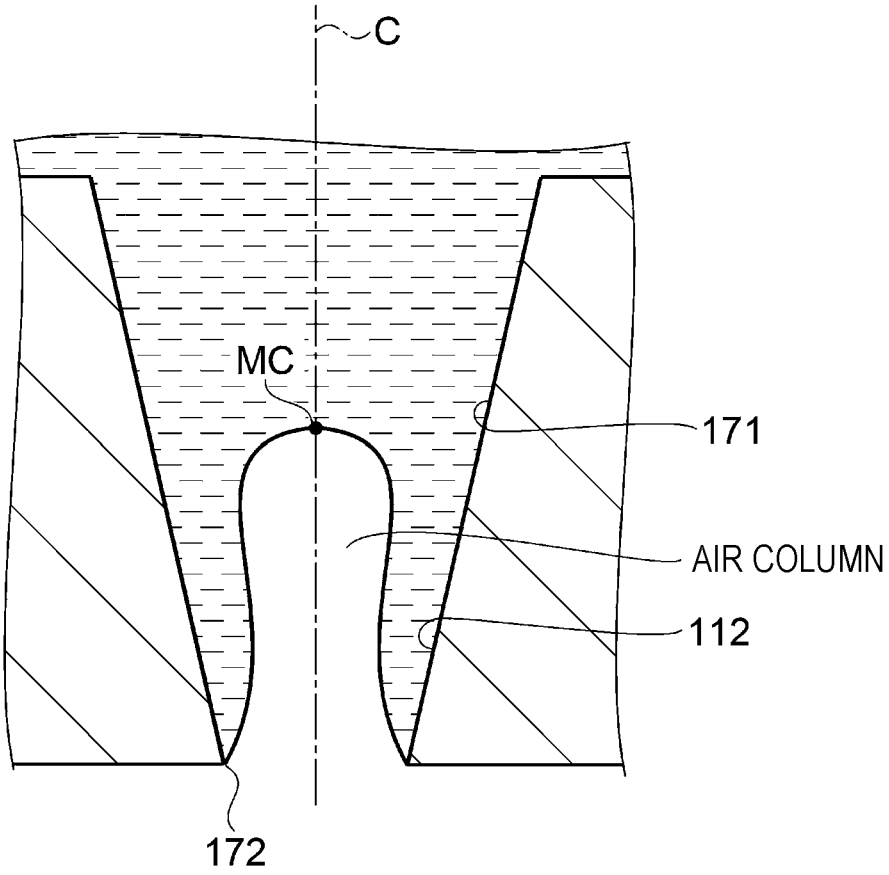
FIG. 7G is a cross-sectional diagram showing the change of the meniscus over time in the nozzle.

In the pushing process in the period t9, the first vibration plate 21 is displaced in the first direction by the second actuator 411 extending until the second actuator 411 reaches the intermediate potential (FIG. 3G). In the pushing process in the period t9, unlike the pushing process in the period t4, no liquid column is formed in the nozzle 112 (FIG. 7G). Therefore, the energy imparted to the liquid in the first liquid chamber 122 by the displacement of the first vibration plate 21 in the first direction is converted into the friction between the nozzle wall surface 171 and the liquid. Therefore, the liquid in the nozzle 112 is not discharged as droplets. The extension speed of the second actuator 411 is a speed at which droplets do not leak from the nozzle 112.

As described above, in the droplet discharge head 11 according to Embodiment 1, the second actuator 411 applies a pressure to a plurality of the first liquid chambers 121, 122, and 123, and the first actuator 311, 312, and 313 applies a pressure to each of the first liquid chambers 121, 122, and 123. The structure of the second actuator 411 tends to be relatively large in order to increase the amount of expansion and contraction, but since the first actuators 311, 312, and 313 are not required to expand and contract as compared with the second actuator 411, it is possible to reduce the size of the first actuator. Thereby, even if it is a high viscosity-droplet discharge head having a plurality of nozzles, a nozzle density can be raised.

Embodiment 2

Schematic Configuration of Droplet Discharge Head

Figure 8A:
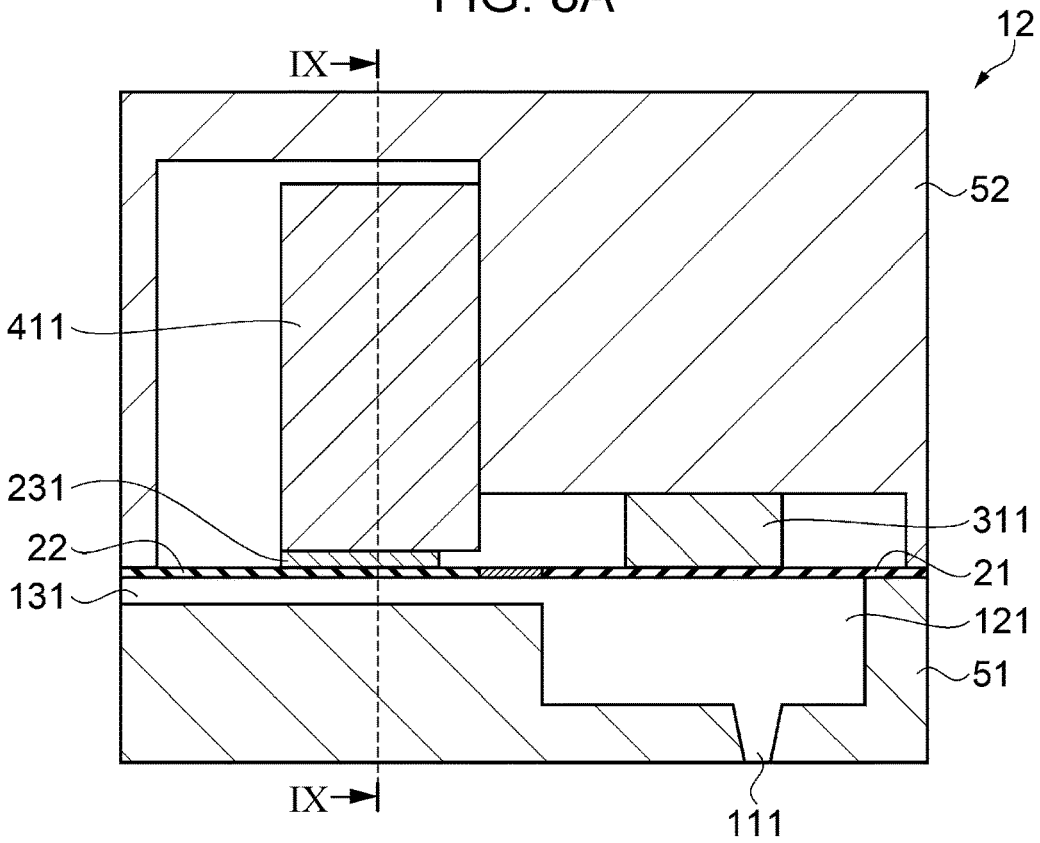
FIG. 8A is a diagram showing an operation of a droplet discharge head according to Embodiment 2.

FIG. 8A is a diagram showing a schematic configuration of a droplet discharge head 12 according to Embodiment 2. Embodiment 2 is different from Embodiment 1 in the configuration in which the second actuator 411 is disposed on the first inflow path 131 via the second vibration plate 22. The first actuator 311 is mechanically coupled to the first vibration plate 21 and is fixed to the lid member 52. The same constituent parts as those of Embodiment 1 are denoted by the same reference numerals, and redundant description is omitted.

Figure 9:
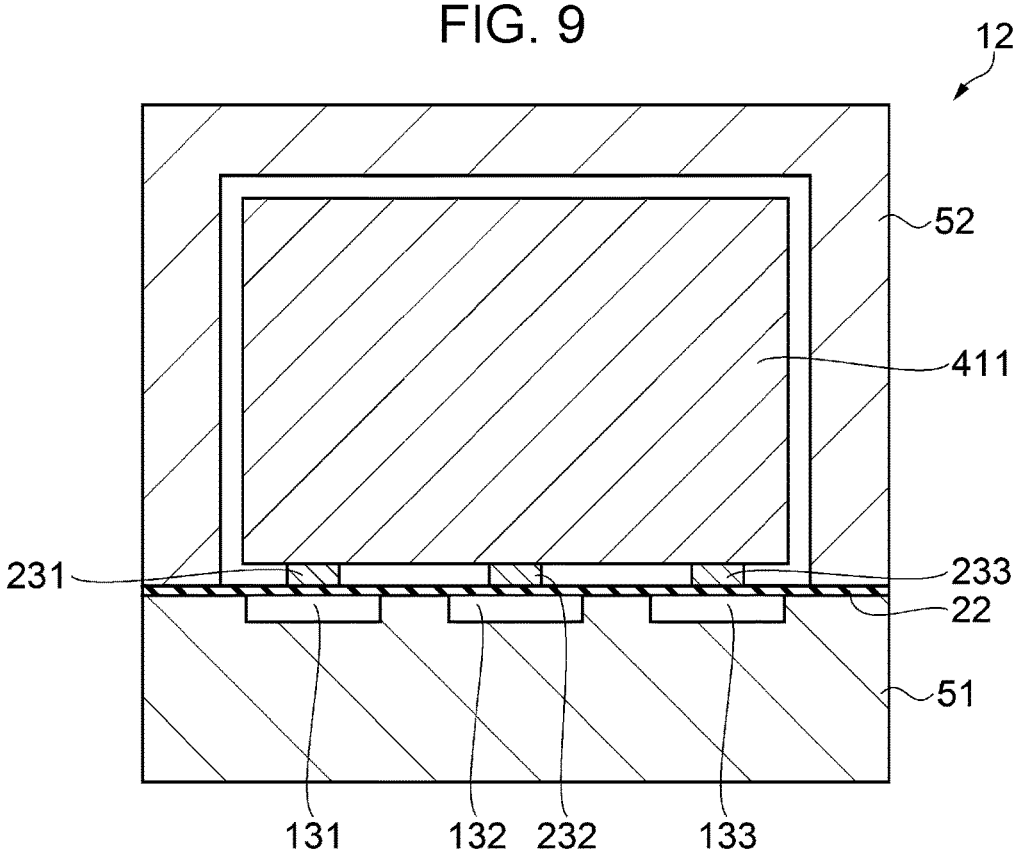
FIG. 9 is a cross-sectional diagram of the droplet discharge head of FIG. 8A viewed from the IX-IX direction.

FIG. 9 is a cross-sectional diagram of the droplet discharge head 12 of FIG. 8A viewed from the IX-IX direction. The second vibration plate 22 is fixed to the flow path forming substrate 51 and constitutes a part of the wall surface of the first inflow path 131. The second vibration plate 22 is a plate-like member (diaphragm) that is configured to be bent and deformed in the first direction and the second direction opposite to the first direction. The first direction refers to a direction in which the second vibration plate 22 is displaced so as to reduce the volume of the first inflow path 131, and the second direction refers to a direction in which the second vibration plate 22 is displaced so as to increase the volume of the first inflow path 131. In other words, the first direction is a direction in which the pressure in the first liquid chamber 121 is increased, and the second direction is a direction in which the pressure in the first liquid chamber 121 is reduced. The second actuator 411 changes the volume of the first inflow path 131, 132, and 133 that communicate with the first liquid chambers 121, 122, and 123. Therefore, for example, the difference in the amount of pressure change between the first liquid chambers 121, 122, and 123 can be reduced as compared with the case where the second actuator changes the volume in the common inflow path.

The second actuator 411 is mechanically coupled to the second vibration plate 22 via a plurality of island portions 231, 232, and 233 and is fixed to the lid member 52. The expansion/contraction amount of the second actuator 411 is larger than that of the first actuators 311, 312, and 313. Thereby, even when the area of the surface of the second actuator 411 that displaces the second vibration plate 22 is large, since the plurality of island portions 231, 232, and 233 can be arranged on the surface of the second actuator 411 that displaces the second vibration plate 22, the nozzles 111, 112, and 113 can be arranged with high density. The island portion 231 may be integrally formed with the second vibration plate 22.

Next, discharge control and non-discharge control methods will be described. In Embodiment 2, since the second actuator 411 is coupled to the plurality of first inflow paths 131, 132, and 133 as shown in FIG. 9, the drive control of the second actuator 411 is the same in the discharge nozzle that discharges the liquid and the non-discharge nozzle that does not discharge the liquid. Here, the control method will be described below assuming that the nozzle 111 is a discharge nozzle and the nozzle 112 is a non-discharge nozzle.

Droplet Discharge Control

FIGS. 8A to 8E are diagrams showing the change of the droplet discharge head 12 over time associated with the droplet discharge control according to Embodiment 2. A timing chart (FIG. 6A) showing a series of droplet discharge control for discharging droplets from the nozzle 111, and a cross-sectional diagrams (FIGS. 7A to 7E) showing the change of the meniscus over time in the nozzle 111 accompanying the droplet discharge control are the same as in Embodiment 1. That is, the droplet discharge head 12 executes an initial state standby process (period t0), a drawing process (period t1), a standby process (period t2), a liquid column forming process (period t3), a pushing process (period t4), and a refilling process (period t5) in a series of discharge control. The alphabet (A to E) of each drawing number in FIGS. 8A to 8E corresponds to the alphabet (A to E) described in FIG. 6A.

In the initial state standby process in the period t0, the liquid in the nozzle 111 before the discharge control is started is maintained at a meniscus pressure resistance or lower. At this time, as shown in FIG. 7A, a boundary ME between the nozzle wall surface 171 and the meniscus is located in the opening 172 of the nozzle 111, and a meniscus MC of the central axis C of the nozzle 111 is located on the first liquid chamber 121 side in the nozzle 111 due to surface tension. This state is defined as a stable state.

Figure 8B:
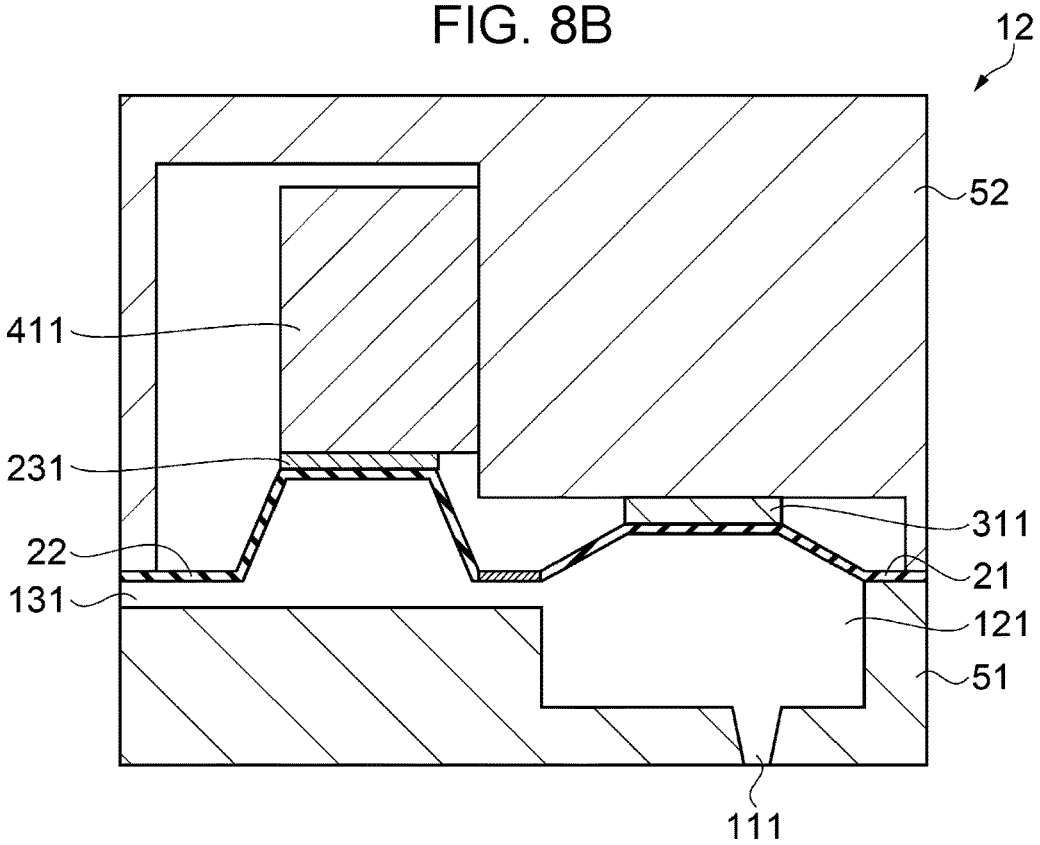
FIG. 8B is a diagram showing the operation of the droplet discharge head according to Embodiment 2.

In the drawing process in the period t1, when the first actuator 311 contracts, the first vibration plate 21 is displaced in the second direction, and when the second actuator 411 contracts, the second vibration plate 22 is displaced in the second direction (FIG. 8B). As a result, the volumes of the first inflow path 131 and the first liquid chamber 121 are expanded, and the pressure in the first liquid chamber 121 is reduced. In this drawing process, the liquid at the center of the nozzle 111 is drawn to the first liquid chamber 121 side, and a pseudo nozzle slightly smaller than the diameter of the nozzle 111 is formed (FIG. 7B).

In the standby process in the period t2, the head control unit 6 holds the position of the first vibration plate 21 by keeping the applied voltage of the first actuator 311 constant and holds the position of the second vibration plate 22 by keeping the applied voltage of the second actuator 411 constant. During this time, the pressure wave generated by driving the first actuator 311 and the second actuator 411 during the period t1 reciprocates at a natural frequency Tc of the first liquid chamber 121.

Figure 8C:
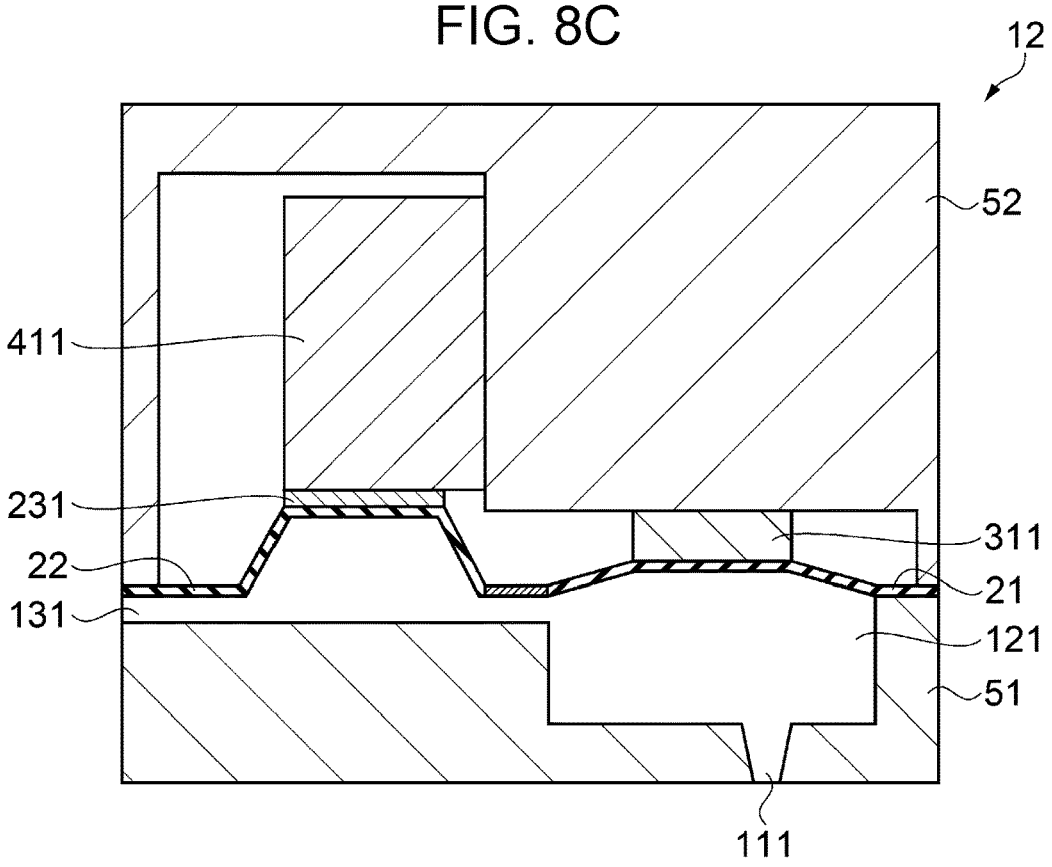
FIG. 8C is a diagram showing the operation of the droplet discharge head according to Embodiment 2.

In the liquid column forming process in the period t3, when the first actuator 311 extends, the first vibration plate 21 is displaced in the first direction, and when the second actuator 411 extends, the second vibration plate 22 is displaced in the first direction (FIG. 8C). As a result, as in Embodiment 1, the meniscus in the nozzle 111 is inverted during the period t3 to form a liquid column (FIG. 7C).

Figure 8D:
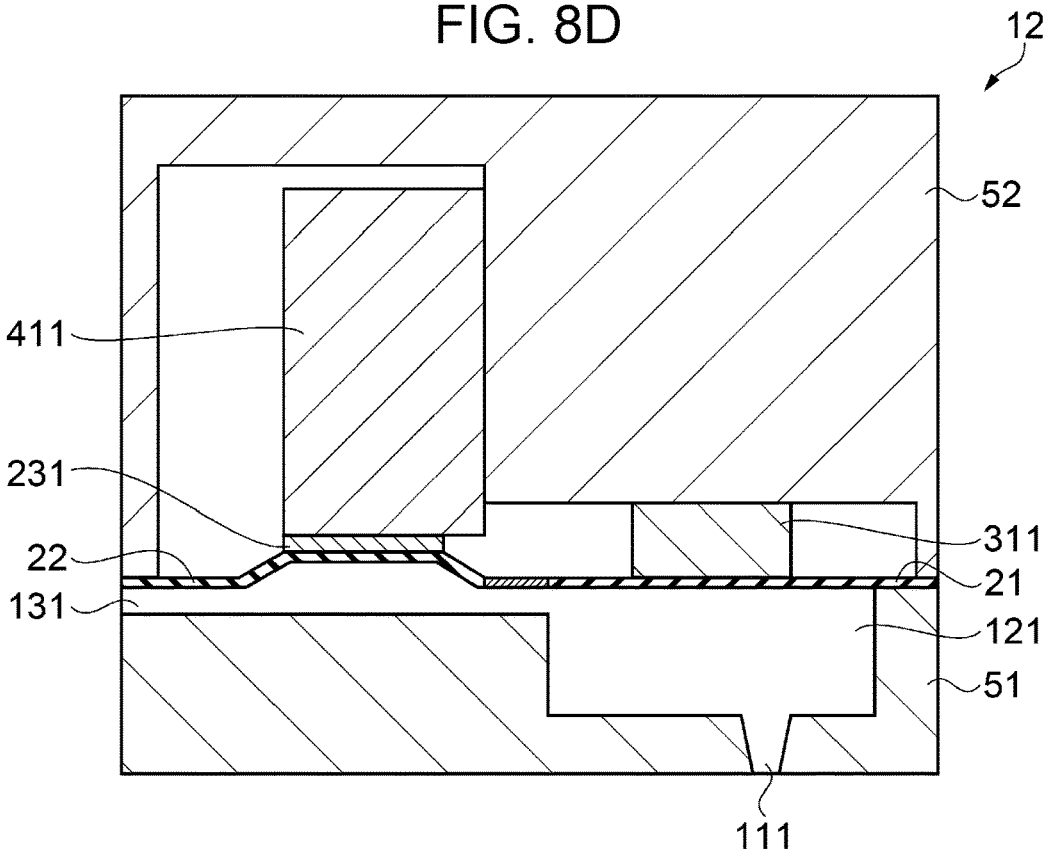
FIG. 8D is a diagram showing the operation of the droplet discharge head according to Embodiment 2.
Figure 8E:
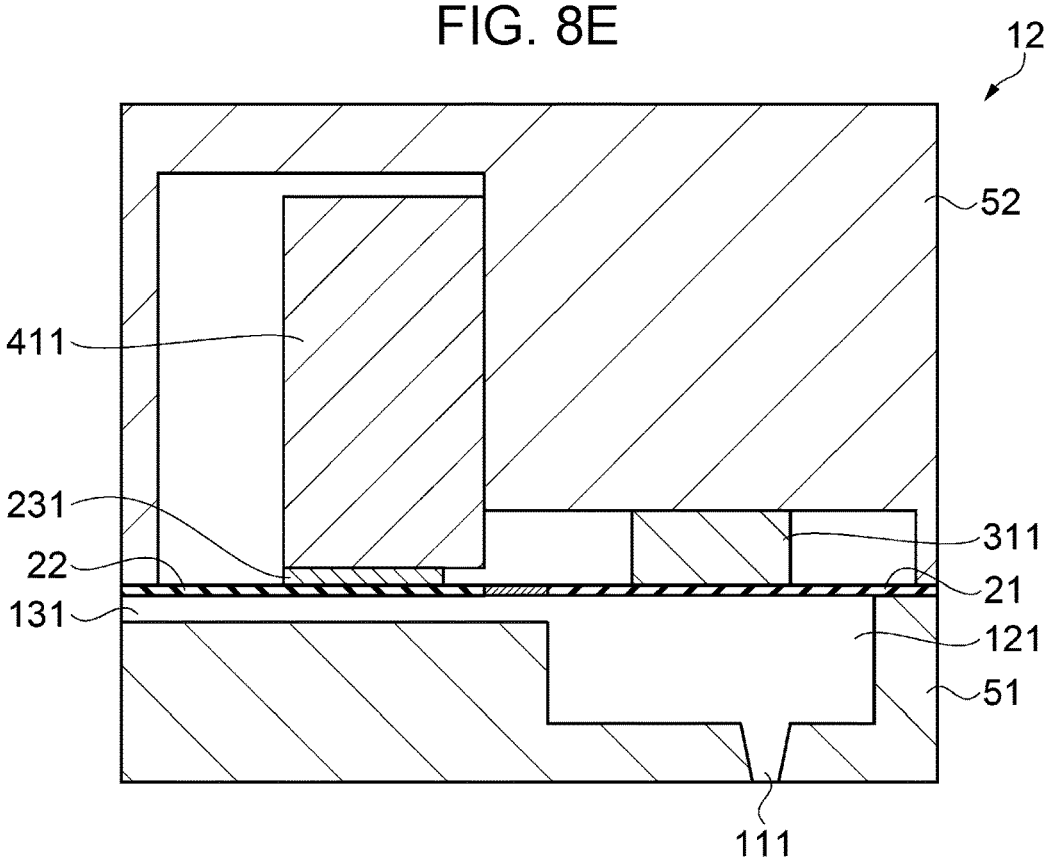
FIG. 8E is a diagram showing the operation of the droplet discharge head according to Embodiment 2.

In the liquid column forming process in the period t3 and the pushing process in the period t4, the second vibration plate 22 is displaced in the first direction until the second actuator 411 reaches the intermediate potential (FIG. 8D). In the period t3 or t4, when the total energy applied to the liquid column exceeds the energy at which the liquid column separates from the meniscus, the liquid column is discharged as a droplet from the opening 172 of the nozzle 111 (FIG. 7D).

In the refilling process in the period t5, the positions of the first vibration plate 21 and the second vibration plate 22 are maintained. At this time, the meniscus in the nozzle 111 returns to the stable state by supplying the liquid from the first inflow path 131.

Non-Discharge Control

FIGS. 8A, 8F, 8G, and 8E are diagrams showing the change of the droplet discharge head 12 over time associated with the non-discharge control according to Embodiment 2. A timing chart (FIG. 6B) showing a series of non-discharge control in which droplets are not discharged from the nozzle 112, and a cross-sectional diagrams (FIGS. 7A, 7F, 7G, and 7E) showing the change of the meniscus over time in the nozzle 112 associated with the non-discharge control are the same as in Embodiment 1. That is, in the series of non-discharge control, the head control unit 6 executes an initial state standby process (period t6), a drawing process (period t7), a standby process (period t8), a pushing process (period t9), and a refilling process (period t10). The alphabets (A, F, G, and E) in FIGS. 8A to 8G correspond to the alphabets (A, F, G, and E) described in FIG. 6B. Since the period t6 and the period t10 are the same control method as the period t0 and the period t5 of the droplet discharge control, description thereof is omitted.

Figure 8F:
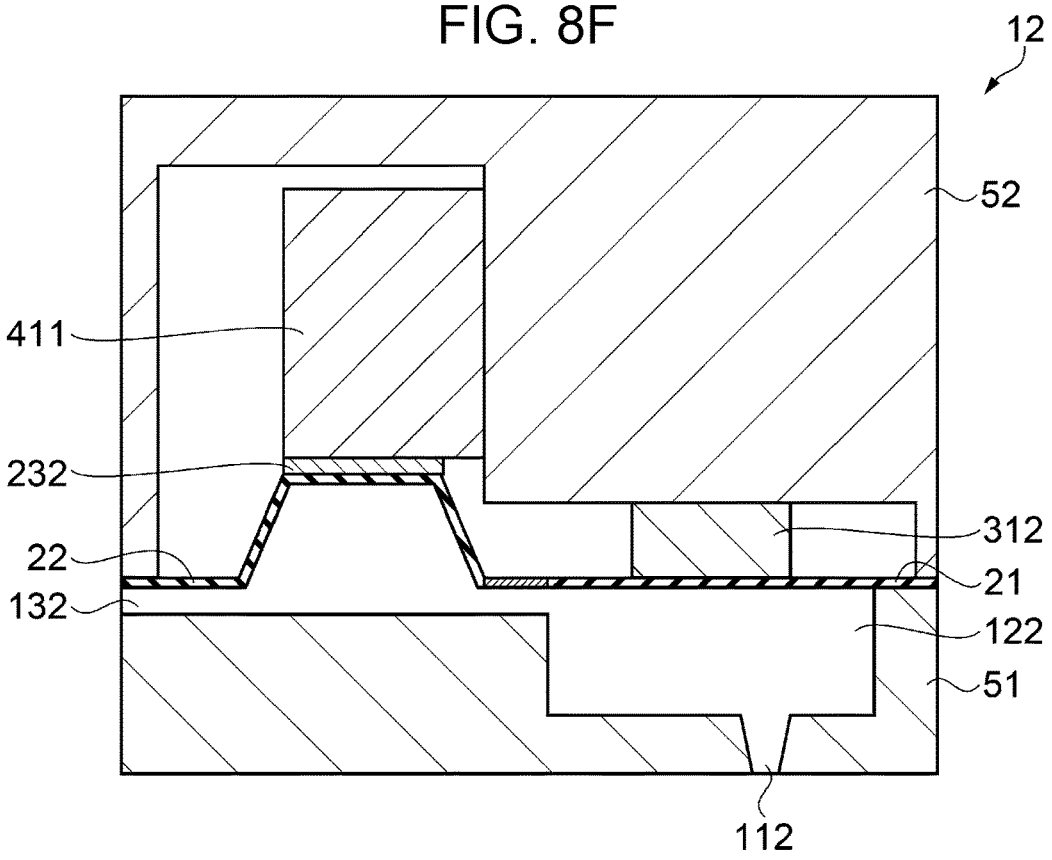
FIG. 8F is a diagram showing the operation of the droplet discharge head according to Embodiment 2.

In the drawing process in the period t7, the second actuator 411 contracts to displace the second vibration plate 22 in the second direction (FIG. 8F). As a result, the volume of the first liquid chamber 122 is increased, and the pressure in the first liquid chamber 122 is reduced. In this drawing process, the liquid at the center of the nozzle 112 is drawn to the first liquid chamber 122 side, and the liquid on the nozzle wall surface 171 remains in place with a predetermined thickness. However, since the first actuator 312 is not driven, the amount of liquid at the center of the nozzle 112 drawn into the first liquid chamber 122 is equal to or less than the drawing process (FIG. 7B) in the period t1 (FIG. 7F).

In the standby process in the period t8, the position of the first vibration plate 21 is maintained by the head control unit 6 holding the applied voltage of the first actuator 312 constant, and the position of the second vibration plate 22 is maintained by holding the applied voltage of the second actuator 411 constant.

Figure 8G:
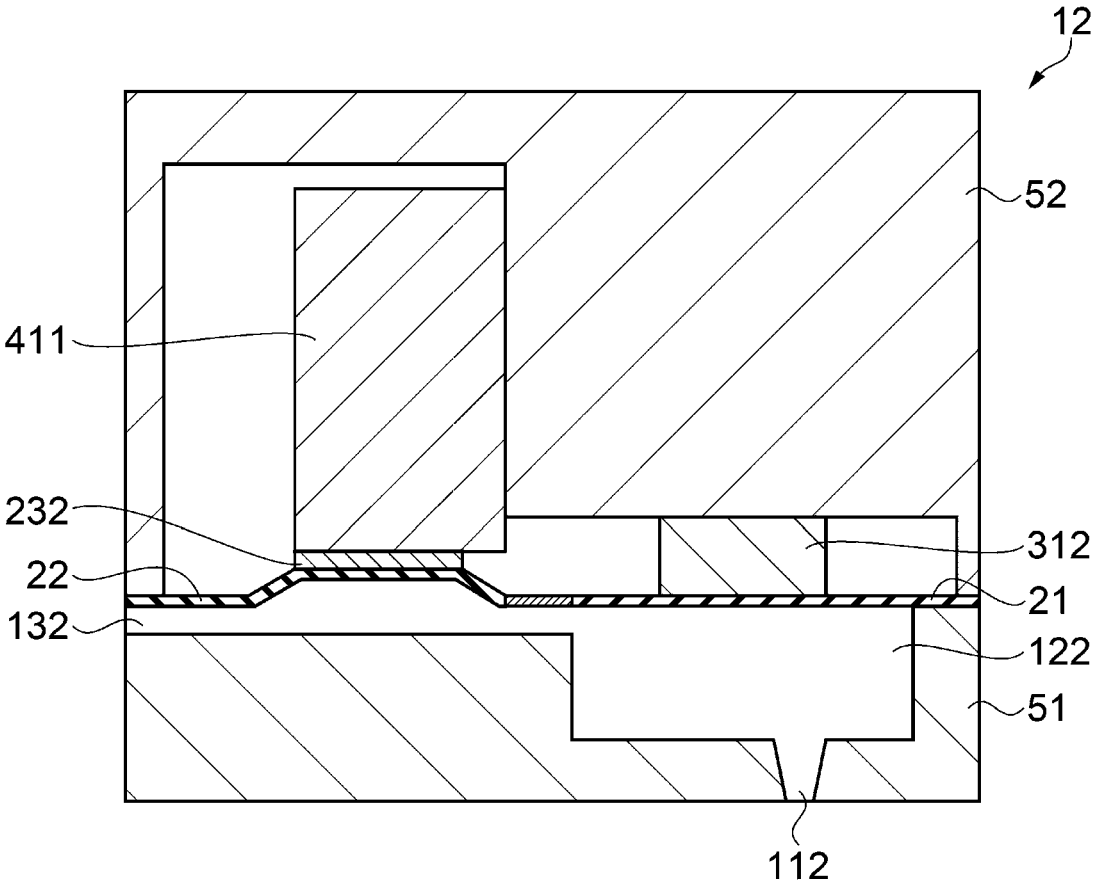
FIG. 8G is a diagram showing the operation of the droplet discharge head according to Embodiment 2.

In the pushing process in the period t9, the second actuator 411 extends until reaching the intermediate potential, whereby the second vibration plate 22 is displaced in the first direction (FIG. 8G). In the pushing process in the period t9, unlike the pushing process in the period t4, no liquid column is formed in the nozzle 112 (FIG. 7G). Therefore, the energy imparted to the liquid in the first liquid chamber 122 by the displacement of the first vibration plate 21 in the first direction is converted into the friction between the nozzle wall surface 171 and the liquid. Therefore, the liquid in the nozzle 112 is not discharged as droplets. The extension speed of the second actuator 411 is a speed at which droplets do not leak from the nozzle 112.

As described above, in the droplet discharge head 12 according to Embodiment 2, the second actuator 411 applies a pressure to a plurality of the first inflow paths 131, 132, and 133, and the first actuator 311, 312, and 313 applies a pressure to each of the first liquid chambers 121, 122, and 123. The structure of the second actuator 411 tends to be relatively large in order to increase the amount of expansion and contraction, but since the first actuators 311, 312, and 313 are not required to expand and contract as compared with the second actuator 411, it is possible to reduce the size of the first actuator. Thereby, even if it is a high viscosity-droplet discharge head having a plurality of nozzles, a nozzle density can be raised.

In the droplet discharge control of Embodiment 2, the start timing of the drawing process of the first actuator 311 and the start timing of the drawing process of the second actuator 411 are the same timing, but the head control unit 6 may drive the first actuator 311 with a delay of predetermined time Δt compared to the second actuator 411. This is because the second actuator 411 is positioned upstream of the first actuator 311 in the liquid flow path. The pressure wave generated by the first actuator 311 propagates to the liquid in the nozzle 111 via the first liquid chamber 121, whereas the pressure wave generated by the second actuator 411 propagates to the liquid in the nozzle 111 via the first inflow path 131 and the first liquid chamber 121. Thereby, the pressure change of the liquid in the nozzle 111 can be appropriately controlled. The first vibration plate 21 and the second vibration plate 22 may be integrally formed.

The present disclosure is not limited to the above-described embodiment, and various modifications and improvements can be added to the above-described embodiment. Modification examples will be described below.

MODIFICATION EXAMPLE 1

Figure 10:
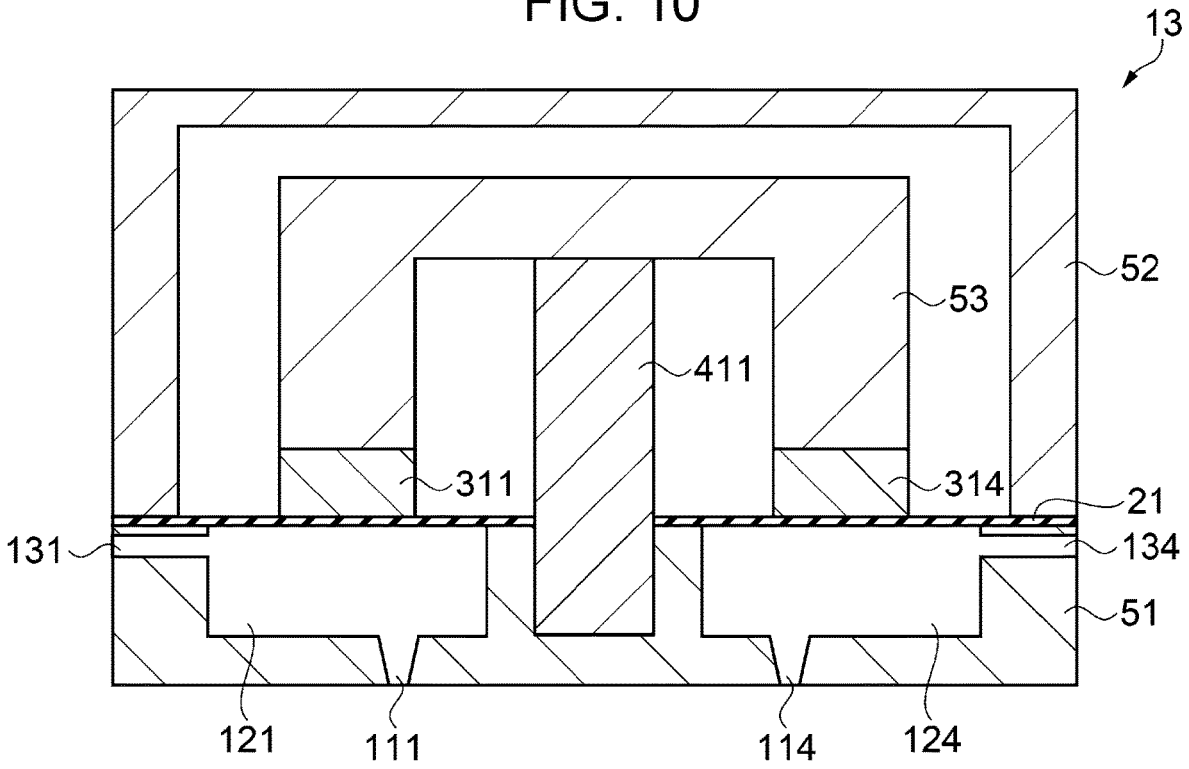
FIG. 10 is a diagram showing a schematic configuration of a droplet discharge head according to Modification Example 1.

In Embodiment 1 described above, the second actuator 411 is disposed on the first actuator 311 as shown in FIG. 3A, but the first actuators 311 and 314 and the second actuator 411 may be mechanically coupled by a bridging member 53 as in the droplet discharge head 13 shown in FIG. 10. The bridging member 53 is a member having higher rigidity than the first vibration plate 21 and is displaced in the same first direction or the second direction as the first vibration plate 21 as the second actuator 411 expands and contracts. The second actuator 411 is fixed to the flow path forming substrate 51 and is disposed between the first actuators 311 and 314. Thereby, the dimension of the height direction of the head can be shortened. Unlike Embodiment 1, when the second actuator 411 extends, the bridging member 53 and the first actuator 311 are displaced in the second direction, and the first vibration plate 21 is displaced in the second direction. In Modification 1, the bridging member 53 is fixed to the plurality of first actuators 311 and 314, but a plurality of bridging members may mechanically couple the first actuators 311 and 314 and the second actuator 411.

MODIFICATION EXAMPLE 2

Figure 11:
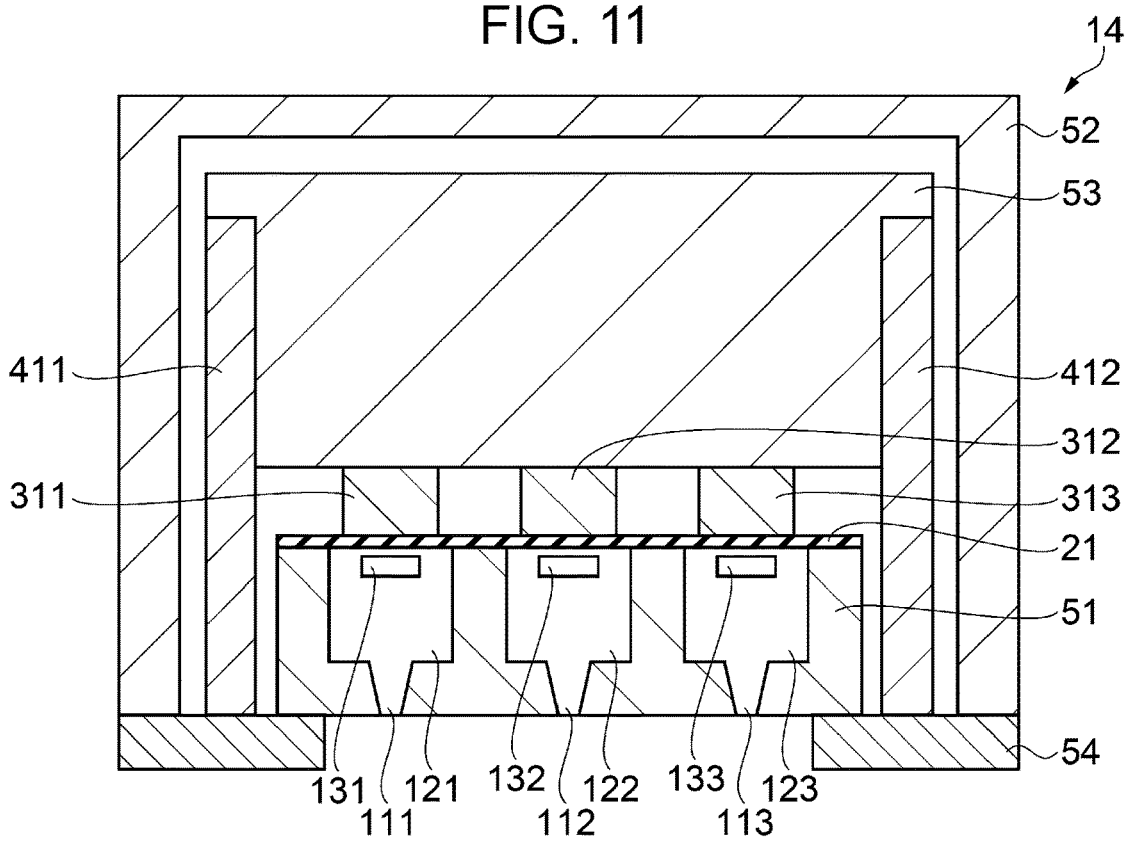
FIG. 11 is a diagram showing a schematic configuration of a droplet discharge head according to Modification Example 2.

In Modification Example 1 described above, it is described that the second actuator 411 is disposed between the first actuators 311 and 314 as shown in FIG. 10, but a plurality of second actuators 411 and 412 may be provided with the first actuators 311, 312 and 313 interposed therebetween as in the droplet discharge head 14 shown in FIG. 11. The second actuators 411 and 412 are mechanically coupled to the first actuators 311 and 312 and 313 by the bridging member 53. As a result, heat generated by driving the second actuators 411 and 412 can be easily dissipated. The plurality of second actuators 411 and 412 may be fixed to a fixed plate 54 as shown in FIG. 11. Since the second actuator 411 does not have to be disposed on the flow path forming substrate 51, the shape and size of the second actuators 411 and 412 can be freely set. The second actuators 411 and 412 may be arranged parallel to the nozzle row as long as the nozzle row is interposed. The second actuators 411 and 412 may be the same actuator. At this time, the second actuator is disposed so as to surround the nozzle row.

MODIFICATION EXAMPLE 3

Figure 12:
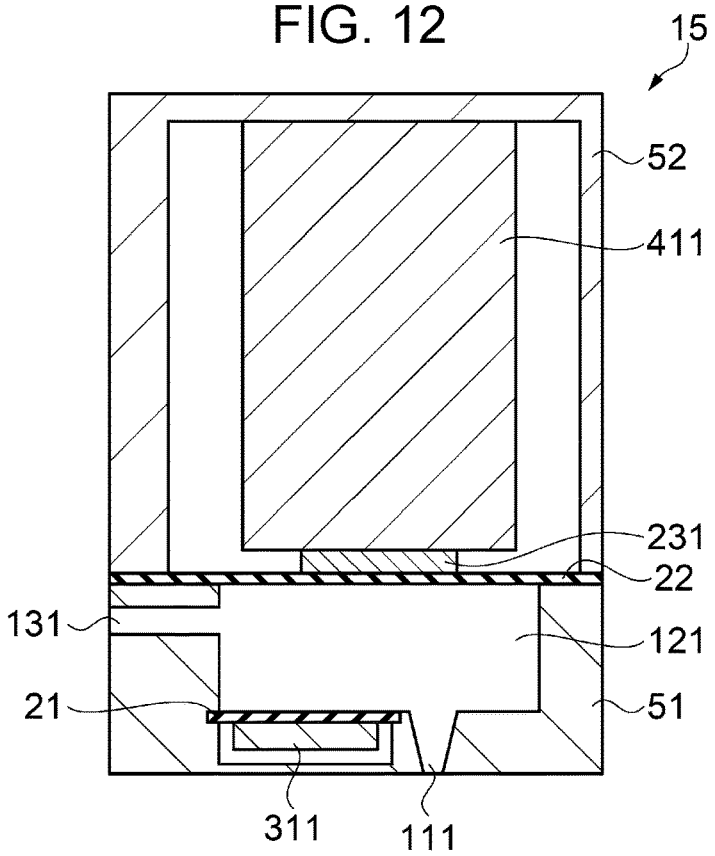
FIG. 12 is a diagram showing a schematic configuration of a droplet discharge head according to Modification Example 3.

In Embodiment 2, as shown in FIG. 8A, it is described that the second actuator 411 is disposed on the second vibration plate 22 forming a part of the wall surface of the first inflow path 131, but the second vibration plate 22 may form a part of the wall surface of the first liquid chamber 121 as in the droplet discharge head 15 shown in FIG. 12. Thereby, the propagation path of the pressure wave generated by the second actuator 411 can be shortened, and the responsiveness of the meniscus response to the displacement of the second vibration plate 22 is improved. The first vibration plate 21 and the second vibration plate 22 are preferably arranged with the first liquid chamber 121 interposed therebetween. Thereby, it is possible to reduce the volume of the first liquid chamber 121 while suppressing the first vibration plate 21 and the second vibration plate 22 from decreasing the area forming the wall surface of the first liquid chamber 121, thereby improving the responsiveness of the liquid in the nozzle 111. The first actuator 311 may be a thin film piezoelectric element as shown in FIG. 12. Thereby, a degree of freedom with respect to the location of the first actuator 311 is created. For example, as shown in FIG. 12, when the first liquid chamber 121 is provided on the opening 172 side of the nozzle 111, since the thickness of the first actuator 311 is thin, it is possible to suppress the nozzle 111 from becoming long and the responsiveness of the liquid in the nozzle 111 from falling.

MODIFICATION EXAMPLE 4

Figure 13:
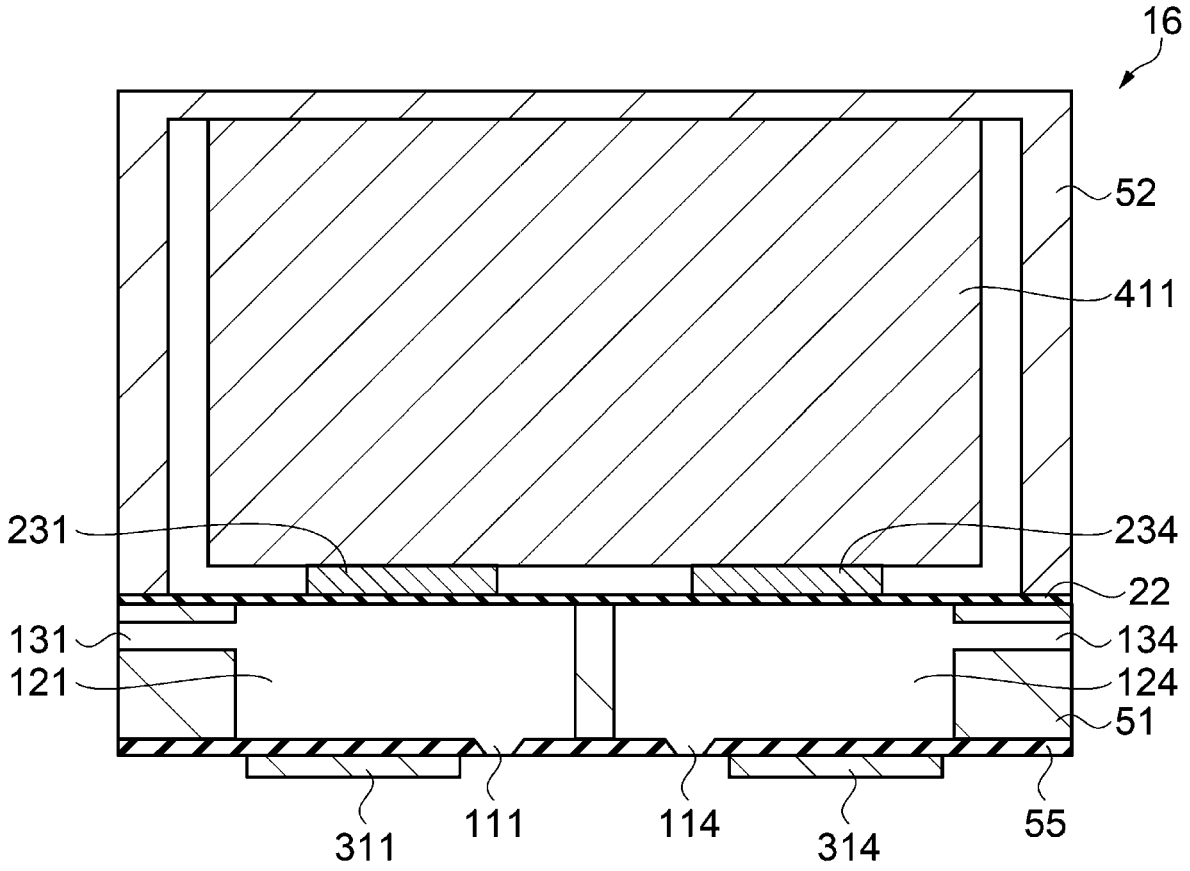
FIG. 13 is a diagram showing a schematic configuration of a droplet discharge head according to Modification Example 4.

In Modification Example 3, as shown in FIG. 12, it is described that the first actuator 311 is disposed on the first vibration plate 21 forming a part of the wall surface of the first liquid chamber 121, but the first actuator 311 may be disposed on the flow path forming substrate (nozzle plate 55) on which the nozzles 111 are formed as in the droplet discharge head 16 shown in FIG. 13. That is, the nozzle plate 55 functions as the first vibration plate 21 in FIG. 12. The head control unit 6 drives the first actuators 311 and 314 to bend and deform the nozzle plate 55, whereby the first actuator 311 applies a pressure to the first liquid chamber 121, and the first actuator 314 applies a pressure to the first liquid chamber 124. As a result, the pressure wave generated by the first actuators 311 and 314 can shorten the propagation path to the nozzles 111 and 114, thereby improving the responsiveness of the meniscus to the driving of the first actuators 311 and 314.

MODIFICATION EXAMPLE 5

Figure 14:
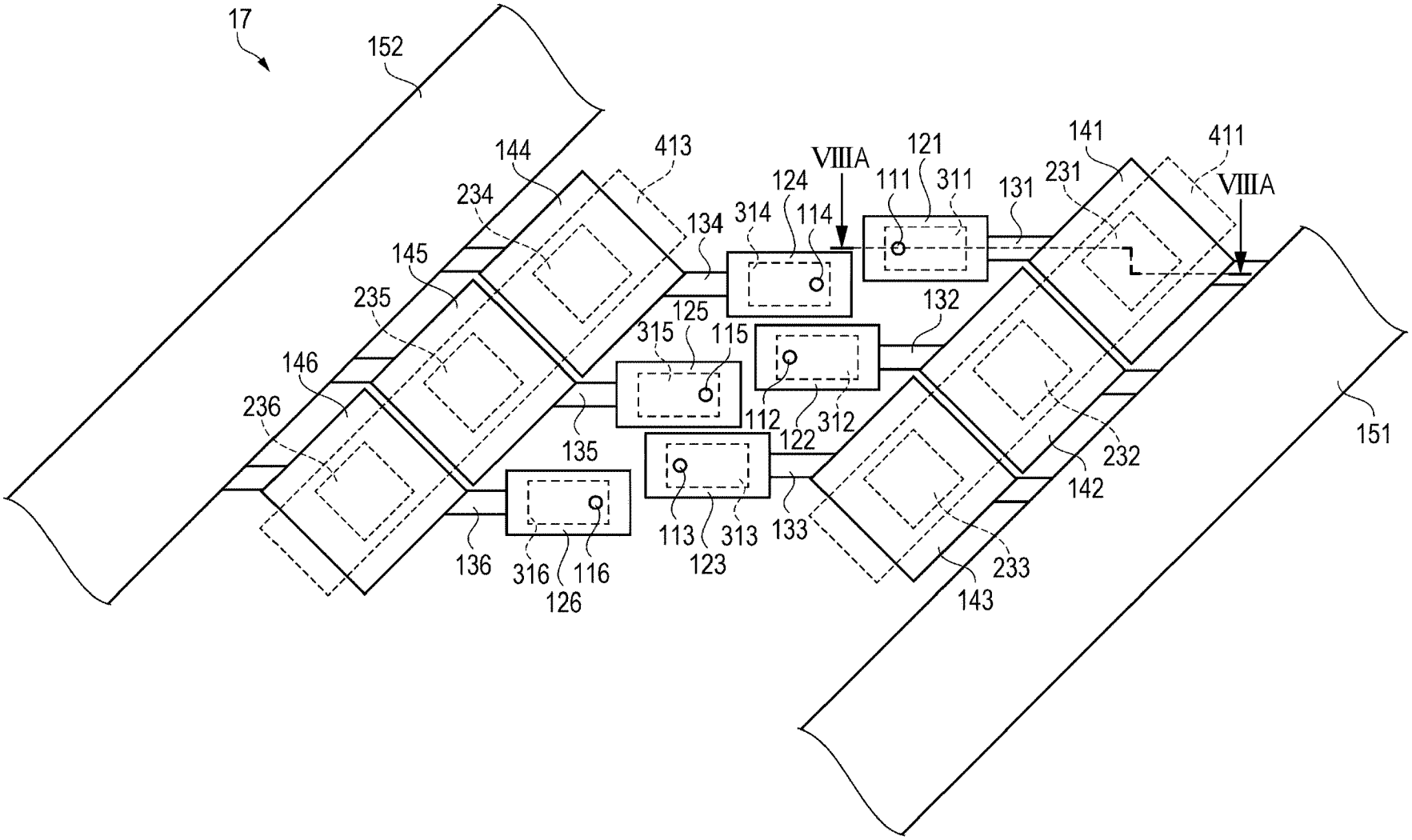
FIG. 14 is a schematic diagram of a flow path structure configured on a flow path forming substrate of a droplet discharge head according to Modification 5, as viewed from a first direction.

In Embodiment 2, as shown in FIG. 8A, it is described that the second actuator 411 is disposed on the second vibration plate 22 forming a part of the wall surface of the first inflow path 131, but as in the droplet discharge head 17 shown in FIG. 14, the first inflow paths 131, 132, 133, 134, 135, and 136 may have second liquid chambers 141, 142, 143, 144, 145, and 146 having a longer width than the first inflow paths. FIG. 14 is a schematic diagram of the flow path structure formed on the flow path forming substrate 51 of the droplet discharge head 17 as viewed from the first direction. The first vibration plate 21, the second vibration plate 22, and the lid member 52 present on the second direction side of the flow path forming substrate 51 are not shown, and the first actuators 311, 312, 313, 314, 315, and 316, the second actuators 411 and 413, and the island portions 231, 232, 233, 234, 235, and 236 are indicated by broken lines. FIG. 8A is a sectional diagram of the droplet discharge head 17 of FIG. 14 viewed from the VIIIA-VIIIA direction. Here, the width of the first inflow path is the length of the first inflow path in the direction perpendicular to the paper surface of FIG. 8A and can be said to be a direction parallel to the second vibration plate in a plane perpendicular to the liquid flow line. Thereby, the excluded volume of the second vibration plate 22 can be increased. The first inflow paths 131, 132, and 133 communicate with the common first inflow path 151, and the first inflow paths 134, 135, and 136 communicate with the common second inflow path 152, respectively.

MODIFICATION EXAMPLE 6

Figure 15:
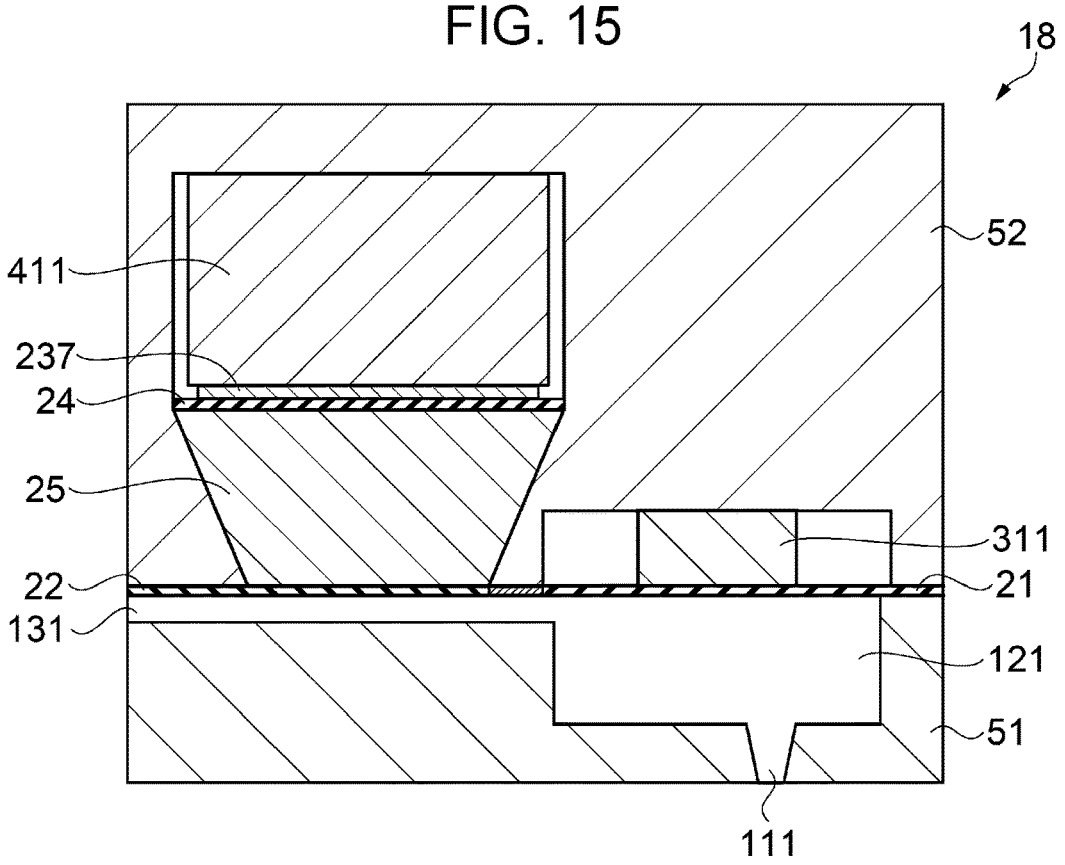
FIG. 15 is a diagram showing a schematic configuration of a droplet discharge head according to Modification Example 6.

In Embodiment 2, it is described that the second actuator 411 is disposed on the second vibration plate 22 forming a part of the wall surface of the first inflow path 131 as shown in FIG. 8A, but as in the droplet discharge head 18 shown in FIG. 15, a displacement amplifying mechanism may be provided between the second actuator 411 and the second vibration plate 22. The displacement amplifying mechanism includes a second vibration plate 22, a third vibration plate 24, and a storage chamber 25. The storage chamber 25 and the first inflow path 131 are separated by the second vibration plate 22. The third vibration plate 24 is a plate-like member (diaphragm) forming a part of the wall surface of the storage chamber 25 and can be deformed flexibly. The second actuator 411 is disposed on an island portion 237 on the surface opposite to the surface forming the wall surface of the storage chamber 25 of the third vibration plate 24. The storage chamber 25 is sealed with liquid, sol, gel, elastic body, and the like. The wall area of the storage chamber 25 formed by the third vibration plate 24 is larger than the wall area of the storage chamber 25 formed by the second vibration plate 22. Since the volume change amount of the storage chamber 25 due to the expansion and contraction of the second actuator 411 and the volume change amount by which the second vibration plate 22 is displaced do not change, the displacement amount of the second vibration plate 22 with respect to the expansion/contraction amount of the second actuator 411 can be increased along with the area ratio.

MODIFICATION EXAMPLE 7

Figure 16:
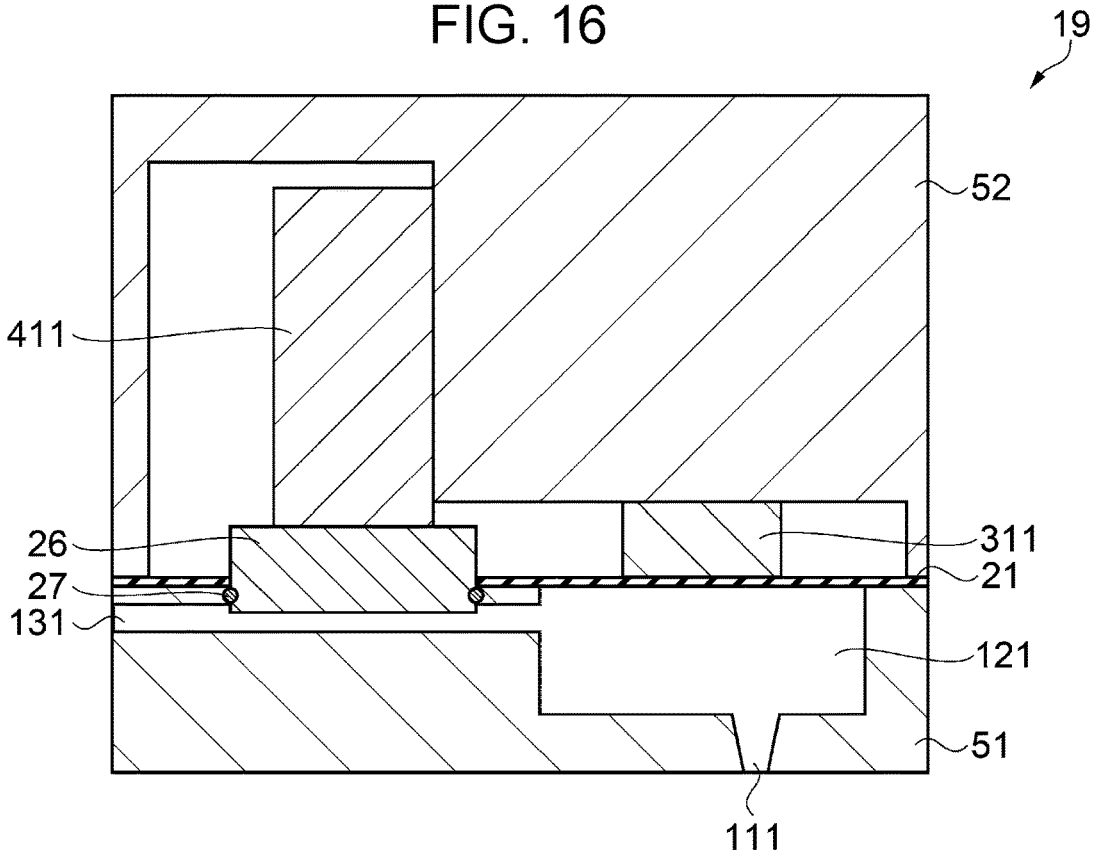
FIG. 16 is a diagram showing a schematic configuration of a droplet discharge head according to Modification Example 7.

In Embodiment 2, as shown in FIG. 8A, the second vibration plate 22 is described as a plate-like member (diaphragm) that can be bent and deformed, but as in the droplet discharge head 19 shown in FIG. 16, the second vibration plate 26 may be a reciprocating piston. The second vibration plate 26 is mechanically coupled to the second actuator 411, and a sealing member 27 is provided in the gap between the second vibration plate 26 and the flow path forming substrate 51. Thereby, the displacement amount of the second vibration plate 26 can be freely set without increasing the width of the first inflow path 131.

MODIFICATION EXAMPLE 8

It is described that the droplet discharge head 12 of Embodiment 2 includes the first inflow path 131 and the nozzle 111, but may further communicate with the outflow path 161. One opening of the outflow path 161 communicates with the first liquid chamber 121. The other opening of the outflow path 161 communicates with the first tank 961 or the second tank 962. Thereby, it is possible to suppress discharge failure due to thickening of the liquid in the first liquid chamber 121 or the nozzle 111 and discharge failure due to bubbles mixed from the opening 172 of the nozzle 111.

MODIFICATION EXAMPLE 9

Figure 17:
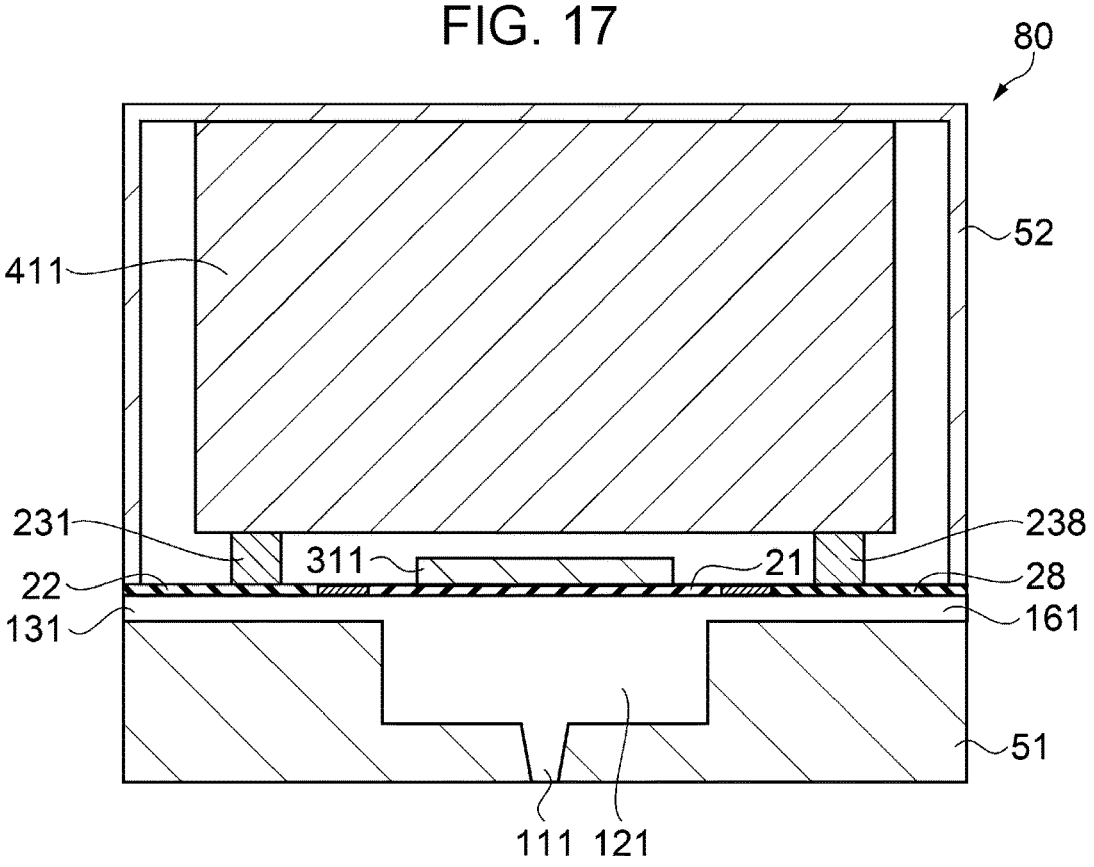
FIG. 17 is a diagram showing a schematic configuration of a droplet discharge head according to Modification Example 9.

In Modification Example 8 above, as in the droplet discharge head 80 shown in FIG. 17, the second actuator 411 may be disposed not only on the second vibration plate 22 but also on a fourth vibration plate 28 forming a part of the wall surface of the outflow path 161. Thereby, the volume change amount of the outflow path 161 and the first inflow path 131 can be increased with respect to the expansion/contraction amount of the second actuator 411. The first vibration plate 21, the second vibration plate 22, and the fourth vibration plate 28 may be integrally formed.

MODIFICATION EXAMPLE 10

Figure 18:
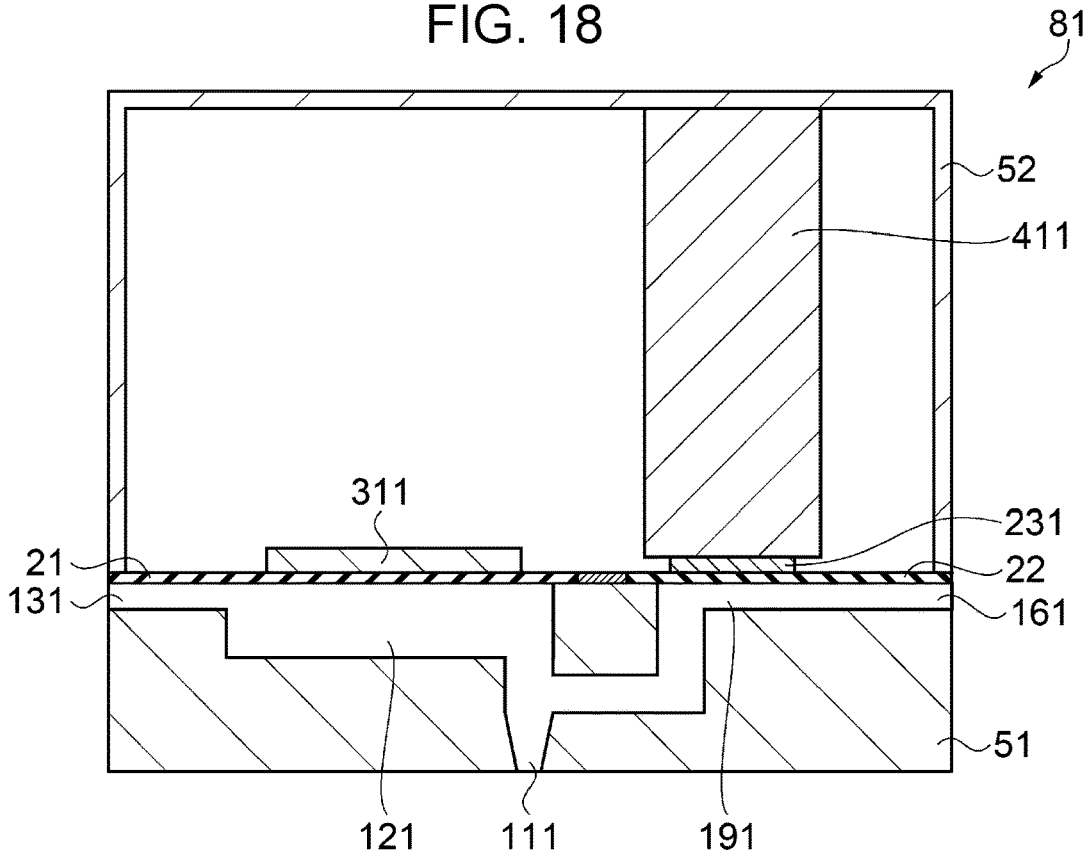
FIG. 18 is a diagram showing a schematic configuration of a droplet discharge head according to Modification Example 10.

In the above modification 8, it is described that one opening of the outflow path 161 communicates with the first liquid chamber 121, but as shown in the droplet discharge head 81 of FIG. 18, one opening of the outflow path 161 may communicate with the nozzle 111. Even in this way, the effect similar to the above can be obtained.

MODIFICATION EXAMPLE 11

Figure 19A:
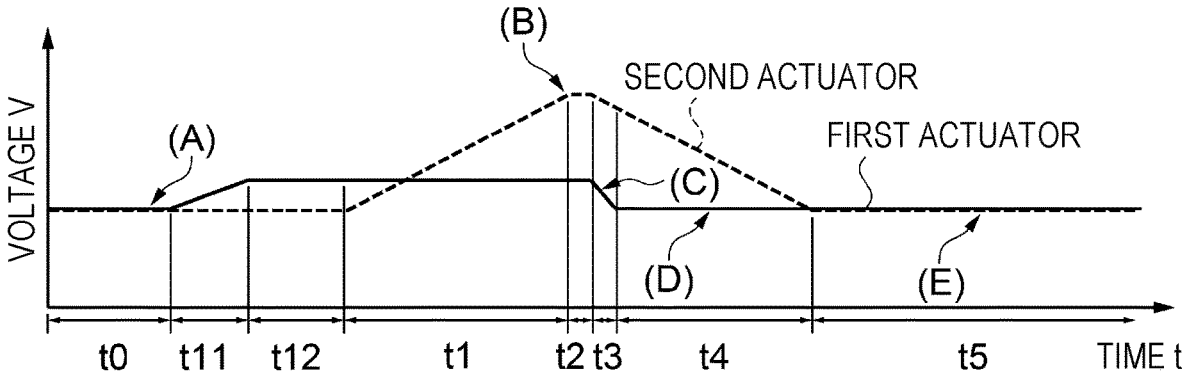
FIG. 19A is a timing chart of droplet discharge control according to Modification Example 11.

In the above embodiment, in the timing chart of droplet discharge control (FIG. 6A), the contraction of the first actuator 311 and the second actuator 411 is executed in the period t2, but the first actuator 311 may be contracted prior to the drawing process in the period t2 to displace the first vibration plate 21 in the second direction (period t11 in FIG. 19A). Even in this way, the effect similar to the above can be obtained.

MODIFICATION EXAMPLE 12

Figure 19B:
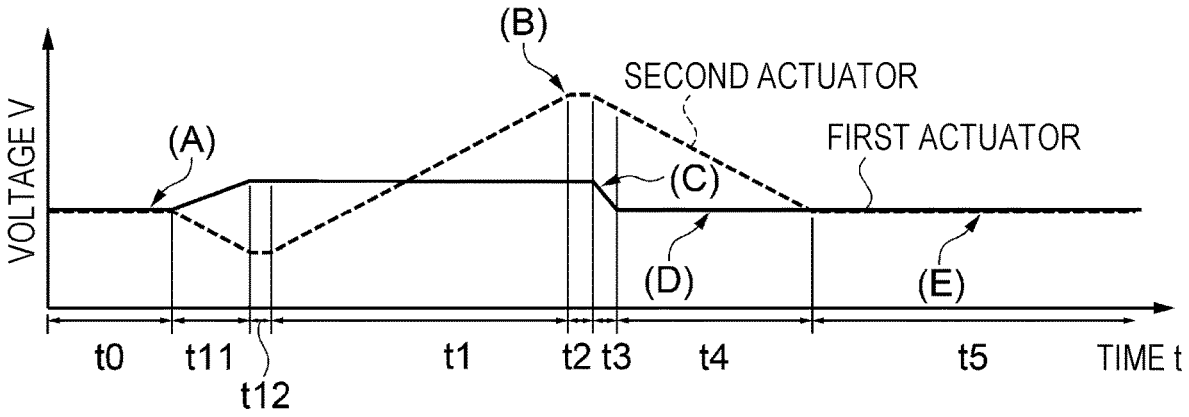
FIG. 19B is a timing chart of droplet discharge control according to Modification Example 12.

In the above modification example, in the droplet discharge control timing chart (FIG. 6A), the drawing process of the first actuator 311 is executed before the drawing process (period t2) of the second actuator 411, but in the drawing process of the first actuator 311 (period t11), the second actuator 411 may be extended to displace the first vibration plate 21 in the first direction (FIG. 19B). Thereby, the displacement amount of the first vibration plate 21 in the drawing process (period t1) of the second actuator 411 can be increased, and it is easy to draw in the liquid in the nozzle 111 largely. When the first actuator 311 contracts during the period t11, the amount of displacement of the first vibration plate 21 in the first direction can be reduced, and liquid leakage from the nozzle 111 can be suppressed.

MODIFICATION EXAMPLE 13

Figure 19C:
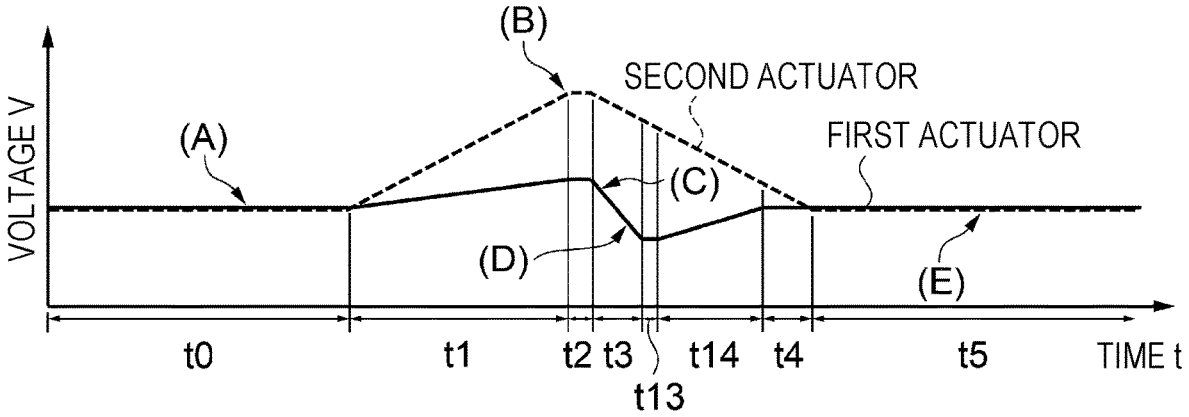
FIG. 19C is a timing chart of droplet discharge control according to Modification Example 13.

In the above embodiment, in the droplet discharge control timing chart (FIG. 6A), in the liquid column forming process, the first actuator 311 extends until reaching the intermediate potential, but may extend beyond the intermediate potential (FIG. 19C). Thereby, the liquid column formed in the nozzle 111 can be pressurized efficiently.

MODIFICATION EXAMPLE 14

Figure 19D:
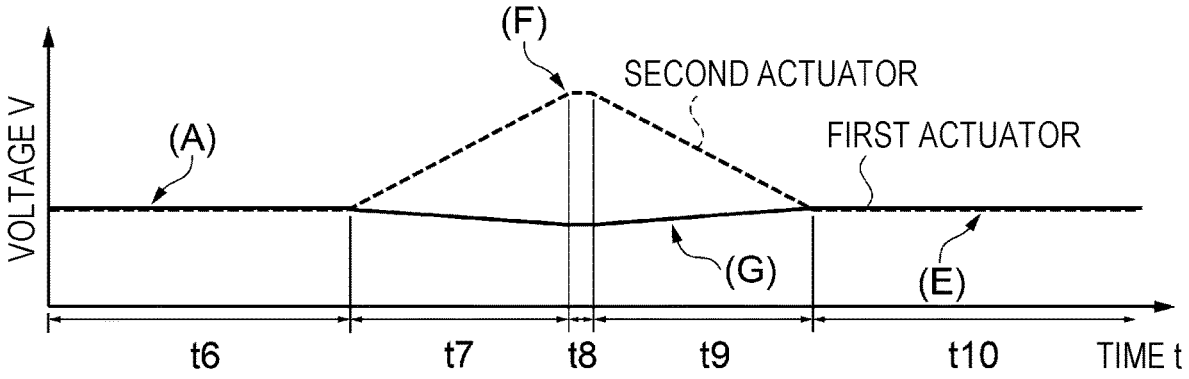
FIG. 19D is a timing chart of non-discharge control according to Modification Example 14.

In the above embodiment, in the non-discharge control timing chart (FIG. 6B), the first actuator 312 is not driven in the drawing process and pushing process, but a counter pulse may be applied to the first actuator 312 (FIG. 19D). However, the expansion/contraction amount of the first actuator 312 is smaller than that of the second actuator 411. Thereby, the behavior of the meniscus in the non-discharge nozzle 112 can be reduced, and drying of the liquid in the nozzle is suppressed.

MODIFICATION EXAMPLE 15

The second actuator 411 of the above embodiment may be configured by various elements that generate displacement, such as an air cylinder, a solenoid, and a magnetostrictive element. In this way, the same effect as described above can be obtained.

MODIFICATION EXAMPLE 16

In the above embodiment, liquids of different colors may be supplied to the plurality of first liquid chambers 121, 122, and 123, respectively. In this way, the same effect as described above can be obtained.

MODIFICATION EXAMPLE 17

In the above embodiment, when the droplet discharge head discharges droplets continuously (that is, the timing charts of FIGS. 6A and 6B are repeated), the period t0 and the period t6 in a second and subsequent discharge operations may be omitted. As a result, the droplet discharge interval is shortened, and the printing speed can be increased.

MODIFICATION EXAMPLE 18

In the above embodiment, the transport mechanism 94 is described as the recording medium transport mechanism 942 and the carriage moving mechanism 941, but the transport mechanism may be a 3D drive stage, and when the droplet discharge head is a line head, the carriage moving mechanism 941 may be omitted.

MODIFICATION EXAMPLE 19

In the above embodiment, the nozzle 111 according to the above-described embodiment is described as a tapered shape, the nozzle 111 may have a cylindrical shape. In the cylindrical nozzle, the shape of the meniscus drawn into the nozzle in the drawing process can be stabilized. Thereby, repeatability can be improved.

The contents derived from the embodiment will be described below.

A droplet discharge head of the present application each includes a first liquid chamber formed on a flow path forming substrate, a nozzle communicating with the first liquid chamber, and a first inflow path for supplying a liquid to the first liquid chamber, and a first actuator that individually changes a pressure in the first liquid chamber, a second actuator that changes pressures in a plurality of first liquid chambers in common, in which an expansion/contraction amount of the second actuator is larger than that of the first actuator.

According to this configuration, the second actuator applies a pressure to the plurality of first liquid chambers, and the first actuator applies a pressure to each first liquid chamber. The structure of the second actuator tends to be relatively large in order to increase the amount of expansion and contraction, but since the first actuators are not required to expand and contract as compared with the second actuator, it is possible to reduce the size of the first actuator. Thereby, even if it is a high viscosity-droplet discharge head having a plurality of nozzles, a nozzle density can be raised.

The droplet discharge head includes a first vibration plate forming a part of the wall surface of the first liquid chamber, in which the first actuator may be fixed to the first vibration plate, and the second actuator may displace the first vibration plate by displacing the first actuator.

According to this configuration, the second actuator having a large expansion/contraction amount reduces the pressure in the nozzle, and therefore the meniscus can be largely drawn into the nozzle and a pseudo nozzle can be formed. After the pseudo nozzle is formed, the first actuator pressurizes the liquid in the nozzle to invert the meniscus in the nozzle and form a liquid column. Furthermore, the first actuators are individually disposed on the first vibration plate of the first liquid chamber, and the second actuator are disposed over the plurality of first actuators, whereby the nozzle density can be increased while maintaining the amount of the meniscus. Thereby, even if it is a high viscosity-droplet discharge head having a plurality of nozzles, a nozzle density can be raised.

In the droplet discharge head, the first actuator may be interposed between the second actuator and the first vibration plate.

According to this configuration, since the first liquid chamber can be efficiently disposed on the flow path forming substrate, the nozzle density can be increased.

The droplet discharge head includes a first vibration plate forming a part of the wall surface of the first liquid chamber, and a second vibration plate forming a part of the wall surface of the first inflow path, in which the first actuator may be fixed to the first vibration plate, and the second actuator may be fixed to the second vibration plate.

According to this configuration, the second actuator having a large expansion/contraction amount reduces the pressure in the nozzle, and therefore the meniscus can be largely drawn into the nozzle and a pseudo nozzle can be formed. After the pseudo nozzle is formed, the first actuator pressurizes the liquid in the nozzle to invert the meniscus in the nozzle and form a liquid column. Furthermore, the first actuators are individually disposed on the first vibration plate of the first liquid chamber, and the second actuator are disposed over the plurality of first inflow paths, whereby the nozzle density can be increased while maintaining the amount of the meniscus. Thereby, even if it is a high viscosity-droplet discharge head having a plurality of nozzles, a nozzle density can be raised.

In the droplet discharge head, a plurality of the first actuators may be disposed with the second actuator interposed therebetween, the first actuator may be fixed to a bridging member, and the second actuator may be fixed to the bridging member.

According to this configuration, the dimension in the height direction of the droplet discharge head can be shortened.

In the droplet discharge head, a plurality of the second actuators may be provided, the plurality of second actuators may be disposed with the first actuator interposed therebetween, the plurality of second actuators may be fixed to a bridging member, and the bridging member may be fixed to a plurality of the first actuators.

According to this configuration, heat generated by driving the second actuator can be easily radiated.

The droplet discharge head includes a first vibration plate forming a part of the wall surface of the first liquid chamber, and a second vibration plate forming a part of the wall surface of the first liquid chamber, in which the first actuator may be fixed to the first vibration plate, and the second actuator may be fixed to the second vibration plate.

According to this configuration, the propagation path of the pressure wave generated by the second actuator can be shortened, and the meniscus response to the displacement of the second vibration plate is improved.

The droplet discharge head includes a nozzle plate forming a part of a wall surface of the first liquid chamber, and a second vibration plate forming a part of the wall surface of the first liquid chamber, in which the nozzle may be formed on a nozzle plate, the first actuator may be fixed to the nozzle plate, and the second actuator may be fixed to the second vibration plate.

According to this configuration, the propagation path of the pressure wave generated by the first actuator to the nozzle can be shortened, thereby improving the responsiveness of the meniscus to the driving of the first actuator.

In the droplet discharge head, the first inflow path may include a second liquid chamber having a larger width than the first inflow path, and the second actuator may be fixed to the second vibration plate forming a part of a wall surface of the second liquid chamber.

According to this configuration, the displacement amount of the second vibration plate can be increased.

The droplet discharge head includes a first vibration plate forming a part of a wall surface of the first liquid chamber, a second vibration plate forming a part of a wall surface of the first inflow path, and a displacement amplifying mechanism for amplifying an expansion/contraction amount of the second actuator to displace the second vibration plate, in which the first actuator may be fixed to the first vibration plate, and the second actuator may be fixed to the second vibration plate via the displacement amplifying mechanism.

According to this configuration, the same effect as described above can be obtained.

The droplet discharge head includes an outflow path through which the liquid flows out from the first liquid chamber, a first vibration plate forming a part of a wall surface of the first liquid chamber, a second vibration plate forming a part of a wall surface of the outflow path, in which the first actuator may be fixed to the first vibration plate, and the second actuator may be fixed to the second vibration plate.

According to this configuration, the same effect as described above can be obtained.

The droplet discharge head of the present application each includes a first liquid chamber formed on a flow path forming substrate, a nozzle communicating with the first liquid chamber, a first inflow path for supplying a liquid to the first liquid chamber, and a second inflow path communicating with the nozzle, and a first actuator that individually changes a pressure in the first liquid chamber, and a second actuator that changes pressures in a plurality of nozzles in common, in which an expansion/contraction amount of the second actuator may be larger than that of the first actuator.

According to this configuration, the pressure fluctuation due to the second actuator is transmitted to the nozzle without passing through the first liquid chamber, and therefore compliance can be reduced.

The droplet discharge head described above is a droplet discharge head is mounted on a droplet discharge apparatus including a control unit for controlling droplet discharge, in which based on a drive signal from the control unit, the second actuator may be driven to draw a meniscus in the nozzle by depressurizing the first liquid chamber, and after the meniscuses in a plurality of the nozzles are drawn, the first actuator may be driven to discharge droplets from the nozzle by pressurizing the first liquid chamber.

According to this configuration, the second actuator having a large expansion/contraction amount reduces the pressure in the plurality of first liquid chambers, and therefore the meniscuses of the plurality of nozzles can be largely drawn and a pseudo nozzle can be formed. After the pseudo nozzle is formed, the first actuator pressurizes the liquid in the plurality of the first liquid chambers to invert the meniscus in the plurality of nozzles and form a liquid column. Furthermore, the first actuator changes the pressure of each first liquid chamber individually, and the second actuator changes the pressures of the plurality of first liquid chambers in common, whereby the nozzle density can be increased while maintaining the amount of the meniscus.

In the droplet discharge head, the plurality of nozzles may include a first nozzle that discharges droplets and a second nozzle that does not discharge droplets, and based on a drive signal from the control unit, after the meniscuses in the plurality of nozzles are drawn, the first actuator corresponding to the first nozzle may be driven to pressurize the first liquid chamber communicating with the first nozzle, and after the meniscuses in the plurality of nozzles are drawn, the first actuator corresponding to the second nozzle may not be driven.

According to this configuration, even when the second actuator changes the pressures of the plurality of first liquid chambers, discharge and non-discharge control can be executed for each nozzle.

In the droplet discharge head, the plurality of nozzles may include a first nozzle that discharges droplets and a second nozzle that does not discharge droplets, and based on a drive signal from the control unit, when the second actuator is driven and the inside of the first liquid chamber is depressurized to draw the meniscus in the first nozzle and the second nozzle, the first actuator of the second nozzle may be driven to pressurize the inside of the first liquid chamber communicating with the first nozzle, and when the second actuator is driven and the inside of the first liquid chamber is pressurized to push the meniscus in the first nozzle and the second nozzle, the first actuator of the second nozzle may be driven to depressurize the first liquid chamber communicating with the first nozzle.

According to this configuration, the behavior of the meniscus in the non-discharge nozzle can be reduced, and drying of the liquid in the nozzle is suppressed.

In the droplet discharge head, the plurality of nozzles may include a first nozzle that discharges droplets and a second nozzle that does not discharge droplets, in which a diameter of a droplet discharged from the first nozzle may be less than two-thirds of an opening of the first nozzle.

According to this configuration, since the inside of the pseudo nozzle diameter liquid film formed in the nozzle has a diameter that is two-thirds of the nozzle inner diameter, a liquid having a diameter less than two-thirds of the nozzle inner diameter can be discharged.

In the droplet discharge head, the speed at which the liquid column formed in the nozzle moves in the direction toward the nozzle opening may be higher than the speed at which the meniscus in the nozzle moves in the direction toward the nozzle opening.

According to this configuration, it is possible to promote separation of the liquid column from the liquid in the nozzle.

The droplet discharge head of the present application each includes a first liquid chamber formed on a flow path forming substrate, a nozzle communicating with the first liquid chamber, a first inflow path for supplying a liquid to the first liquid chamber, and a first actuator that individually changes a pressure in the first liquid chamber, a second actuator for changing the pressure in the plurality of first liquid chambers in common, in which an excluded volume generated by the second actuator may be larger than an excluded volume generated by the first actuator.

According to this configuration, the second actuator applies a pressure to the plurality of first liquid chambers, and the first actuator applies a pressure to each first liquid chamber. The structure of the second actuator tends to be relatively large in order to increase the excluded volume, but since the first actuators are not required to have an excluded volume as compared with the second actuator, it is possible to reduce the size of the first actuator. Thereby, even if it is a high viscosity-droplet discharge head having a plurality of nozzles, a nozzle density can be raised.

What is claimed is:

1. A droplet discharge head comprising:

a first liquid chamber formed on a flow path forming substrate;

a nozzle communicating with the first liquid chamber;

a first inflow path for supplying a liquid to the first liquid chamber;

a first actuator that individually changes a pressure in the first liquid chamber; and a second actuator that changes pressures in each of a plurality of liquid chambers in common, wherein the plurality of liquid chambers include the first liquid chamber, and wherein an expansion/contraction amount of the second actuator is larger than that of the first actuator.

2. The droplet discharge head according to claim 1, further comprising:

a first vibration plate forming a part of a wall surface of the first liquid chamber, wherein the first actuator is fixed to the first vibration plate, and the second actuator displaces the first vibration plate by displacing the first actuator.

3. The droplet discharge head according to claim 2, wherein the first actuator is interposed between the second actuator and the first vibration plate.

4. The droplet discharge head according to claim 2, wherein a plurality of first actuators are disposed with the second actuator interposed therebetween, the plurality of first actuators include the first actuator, the first actuator is fixed to a bridging member, and the second actuator is fixed to the bridging member.

5. The droplet discharge head according to claim 2, wherein a plurality of second actuators are provided, the plurality of second actuators include the second actuator, the plurality of second actuators are disposed with the first actuator interposed therebetween, the plurality of second actuators are fixed to a bridging member, the bridging member is fixed to a plurality of first actuators, and the plurality of first actuators include the first actuator.

6. The droplet discharge head according to claim 1, further comprising:

a first vibration plate forming a part of a wall surface of the first liquid chamber; and a second vibration plate forming a part of a wall surface of the first inflow path, wherein the first actuator is fixed to the first vibration plate, and the second actuator is fixed to the second vibration plate.

7. The droplet discharge head according to claim 6, wherein the first inflow path includes a second liquid chamber having a larger width than the first inflow path, and the second actuator is fixed to the second vibration plate forming a part of a wall surface of the second liquid chamber.

8. The droplet discharge head according to claim 1, further comprising:

a first vibration plate forming a part of a wall surface of the first liquid chamber; and a second vibration plate forming a part of the wall surface of the first liquid chamber, wherein the first actuator is fixed to the first vibration plate, and the second actuator is fixed to the second vibration plate.

9. The droplet discharge head according to claim 1, further comprising:

a nozzle plate forming a part of a wall surface of the first liquid chamber; and a second vibration plate forming a part of the wall surface of the first liquid chamber, wherein the nozzle is formed on the nozzle plate, the first actuator is fixed to the nozzle plate, and the second actuator is fixed to the second vibration plate.

10. The droplet discharge head according to claim 1, further comprising:

a first vibration plate forming a part of a wall surface of the first liquid chamber;

a second vibration plate forming a part of a wall surface of the first inflow path; and a displacement amplifying mechanism for amplifying the expansion/contraction amount of the second actuator to displace the second vibration plate, wherein the first actuator is fixed to the first vibration plate, and the second actuator is fixed to the second vibration plate via the displacement amplifying mechanism.

11. The droplet discharge head according to claim 1, further comprising:

an outflow path through which the liquid flows out from the first liquid chamber;

a first vibration plate forming a part of a wall surface of the first liquid chamber; and a second vibration plate forming a part of a wall surface of the outflow path, wherein the first actuator is fixed to the first vibration plate, and the second actuator is fixed to the second vibration plate.

12. A droplet discharge head comprising:

a first liquid chamber formed on a flow path forming substrate;

a nozzle communicating with the first liquid chamber;

a first inflow path for supplying a liquid to the first liquid chamber;

a second inflow path communicating with the nozzle;

a first actuator that individually changes a pressure in the first liquid chamber; and a second actuator that changes pressures in each of a plurality of nozzles in common, wherein the plurality of nozzles include the nozzle, and wherein an expansion/contraction amount of the second actuator is larger than that of the first actuator.

13. The droplet discharge head according to claim 1, wherein the droplet discharge head is mounted on a droplet discharge apparatus including a control unit for controlling droplet discharge, and based on a drive signal from the control unit, the second actuator is driven to draw a meniscus in the nozzle by depressurizing the first liquid chamber, and after meniscuses in a plurality of nozzles are drawn, the first actuator is driven to discharge droplets from the nozzle by pressurizing the first liquid chamber.

14. The droplet discharge head according to claim 13, wherein the plurality of nozzles include a first nozzle that discharges droplets and a second nozzle that does not discharge droplets, and based on the drive signal from the control unit, after the meniscuses in the plurality of nozzles are drawn, the first actuator corresponding to the first nozzle is driven to pressurize the first liquid chamber communicating with the first nozzle, and after the meniscuses in the plurality of nozzles are drawn, the first actuator corresponding to the second nozzle is not driven.

15. The droplet discharge head according to claim 13, wherein the plurality of nozzles include a first nozzle that discharges droplets and a second nozzle that does not discharge droplets, and based on the drive signal from the control unit, the second actuator is driven and the first liquid chamber is depressurized to draw the meniscus in the first nozzle and the second nozzle, the first actuator of the second nozzle is driven to pressurize the first liquid chamber communicating with the first nozzle, and the second actuator is driven and the first liquid chamber is pressurized to push the meniscus in the first nozzle and the second nozzle, and the first actuator of the second nozzle is driven to depressurize the first liquid chamber communicating with the first nozzle.

16. The droplet discharge head according to claim 13, wherein the plurality of nozzles include a first nozzle that discharges droplets and a second nozzle that does not discharge droplets, and a diameter of a droplet discharged from the first nozzle is less than two-thirds of an opening of the first nozzle.

17. The droplet discharge head according to claim 13, wherein a speed at which a liquid column formed in the nozzle moves in a direction toward an opening of the nozzle is higher than a speed at which the meniscus in the nozzle moves in the direction toward the opening of the nozzle.

18. A droplet discharge head, comprising:

a first liquid chamber formed on a flow path forming substrate;

a nozzle communicating with the first liquid chamber;

a first inflow path for supplying a liquid to the first liquid chamber;

a first actuator that individually changes a pressure in the first liquid chamber; and a second actuator that changes pressures in each of a plurality of liquid chambers in common, wherein the plurality of liquid chambers include the first liquid chamber, and wherein an excluded volume generated by the second actuator is larger than an excluded volume generated by the first actuator.

* * * * *